US011993349B2

(12) United States Patent
Manningham et al.

(10) Patent No.: US 11,993,349 B2
(45) Date of Patent: May 28, 2024

(54) JACK DEVICE AND SYSTEM FOR PULLING BOAT COVERS TAUT AND PROTECTING AGAINST WATER POOLING

(71) Applicants: Joe Manningham, Hamilton (CA); Allison Nielsen, Hamilton (CA)

(72) Inventors: Joe Manningham, Hamilton (CA); Allison Nielsen, Hamilton (CA)

( * ) Notice: Subject to any disclaimer, the term of this patent is extended or adjusted under 35 U.S.C. 154(b) by 271 days.

(21) Appl. No.: 17/476,750

(22) Filed: Sep. 16, 2021

(65) Prior Publication Data

US 2022/0081069 A1 Mar. 17, 2022

Related U.S. Application Data

(60) Provisional application No. 63/079,180, filed on Sep. 16, 2020.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02
USPC ..... 114/361
See application file for complete search history.

(56) References Cited

U.S. PATENT DOCUMENTS 4,768,457 A * 9/1988 Jones ..... B63B 17/02 114/361
9,957,015 B2 * 5/2018 Reden ..... B63B 17/02

* cited by examiner

*Primary Examiner* — Lars A Olson
(74) *Attorney, Agent, or Firm* — Kevin Edward Holbeche

(57) ABSTRACT

A jack device, system, and method pulls boat covers taut and protects against water pooling. An inflatable cylinder, when deflated, is positioned under a boat cover which is snapped into place. An inflating line extends from the cylinder to outside the boat. The cylinder is inflated through the line, from outside the boat, with the cover snapped in place. The cover is pulled taut and the inflating stops.

11 Claims, 20 Drawing Sheets

JACK DEVICE AND SYSTEM FOR PULLING BOAT COVERS TAUT AND PROTECTING AGAINST WATER POOLING

FIELD OF THE INVENTION

The invention relates generally to the field of boat covers and, more particularly, to a jack device, system, and method for pulling boat covers taut and protecting against water pooling.

BACKGROUND OF THE INVENTION

In the prior art, boats may have been covered when stored or not in use—e.g., overnight, or for a week, a season, or any long period of time. Water may have pooled on covered boats. Boats and boat covers may have suffered damage from water pooling.

In prior art related to the invention, mechanical telescopic supports may have been used in an effort to keep boat covers taut and to prevent water pooling. They may, however, have been somewhat of a nuisance, unreliable, and/or awkward to install. Some prior art may have required two such mechanical telescopic supports in the attempt to pull a boat cover taut and/or to prevent water pooling. It may, however, have been exceedingly difficult to keep two such telescopic supports still standing while pulling the cover over the boat and trying to snap it to the boat's edges. Users may, in fact, have taken multiple attempts to do so, often with the frustration of pulling over one or both of the supports and/or causing them to fall over owing to the user's efforts. It may have involved a fine balance to pull a boat cover into position without pulling over such prior art supports.

Also, mechanical telescopic supports may have caused extensive wear on boat covers. A certain amount of pull may have been required to make the supports stand properly in position and, over time, that may have caused holes to form in the boat covers. Additionally or instead, after a boat was stored for a period of time, eventually these prior art supports may have fallen, defeating the purpose of having them at all, as water pools on the cover.

Other prior art related to the invention may have called for the use of complete frame and tarp assemblies over boats. But, such assemblies may have been somewhat expensive and/or rare. They may have been relatively large, cumbersome, and/or time-consuming to store, handle, and/or install. In the prior art, complete frame and tarp assemblies typically may have been used only when boats were left for a season or another relatively long period of time. Such assemblies were not, however, practical when just leaving boats overnight or even for a week.

When installing prior art devices, all parts and components may need to have been very carefully and correctly aligned when it came time to apply the cover. Otherwise, users might have found themselves starting over, sometimes several times.

If prior art devices failed during storage (e.g., if the support fell down or shifted), then it may have allowed water pooling, and the cover may need to have been unsnapped, and users might have needed to essentially start over at or near the beginning of the installation process.

Prior art and/or art in non-analogous fields may have suffered from one or more shortcomings and/or disadvantages which may preferably be readily appreciable by and/or suggested, in view of the teachings and/or disclosures hereof, to those skilled in the art associated with boat storage and covers.

What may be needed is a jack device, system, and/or method for use with a boat cover.

What may be needed is a jack device, system, and/or method for pulling boat covers taut and protecting against water pooling.

There may be a need for pneumatically controlled devices, systems, and/or methods to support boat covers, trailer covers, and/or any cover that suits, There may be a need for devices, systems, and/or methods to support and provide covers with a taut surface to prevent, reduce, and/or minimize pooling of water on such covers.

There may be a need for a device, system and/or method which:

- Can be externally and reliably controlled
- May be relatively portable and/or easy to use, install, and/or maintain.
- Enables a user to snap a boat or trailer cover into place, and to then inflate a cylinder from outside the cover to raise it to a desired level.
- Enables a user to simply connect (or reconnect) a pump externally, and inflate a device to remove any pooled water and pull the cover taut again.
- Can be used in a variety of different user environments. And/or,
- Uses a simple mechanism.

It is an object of the present invention to obviate or mitigate one or more disadvantages and/or shortcomings associated with the prior art, to meet or provide for one or more needs and/or advantages, and/or to achieve one or more objects of the invention—one or more of which may preferably be readily appreciable by and/or suggested to those skilled in the art in view of the teachings and/or disclosures hereof.

SUMMARY OF THE INVENTION

According to the invention, there is disclosed a jack device for preferable use with a removable cover secured over a boat (or trailer, etc.) and with a pump outside the boat (or trailer, etc.). The device preferably includes an air bladder, an airline, and/or a two-way valve. The air bladder (alternately referred to, herein, as an "internal cylinder") may preferably be selectively inflatable and/or deflatable. It may preferably have a top portion, and/or be shaped to define an internal air chamber. The air bladder may preferably be adapted to be securely positioned inside the boat under the boat cover. (References herein to boats should also be interpreted to apply, mutatis mutandis, to trailers, etc. Likewise, references herein to boat covers should also be interpreted to apply, mutatis mutandis, to covers for trailers, etc.) The airline may preferably have a pump nozzle. The airline may preferably be connected to the air bladder in fluid communication with the internal air chamber to inflate and/or deflate the air bladder. The pump nozzle may preferably be adapted to be readily connected to the pump outside the boat. The pump nozzle and/or the airline may preferably be adapted for fluid communication of air from the pump to the internal air chamber preferably, thus, to selectively inflate the air bladder when the boat cover is secured over the boat. The two-way valve may preferably be provided on the airline. The two-way valve may preferably be readily and/or selectively controllable and/or positionable either (i) to deflate the air bladder, and/or (ii) to permit fluid communication of air from the pump through the airline to the internal air chamber. The two-way valve on the airline may preferably be adapted to be positioned outside the boat preferably, thus, to permit ready and/or selective control of the two-way valve from outside the boat. Preferably, when the pump nozzle is connected to the pump and/or the two-way valve is positioned to permit the aforesaid fluid communication of air from the pump through the airline to the internal air chamber, and/or when the pump is operated, the air bladder may preferably be inflated and/or the top portion of the air bladder may preferably engage an underside of the boat cover and/or pull the boat cover taut over the boat preferably, thus, to help minimize and/or protect against water pooling on the boat cover.

According to an aspect of the invention, the air bladder, the airline, and/or the two-way valve may preferably, but need not necessarily, be readily portable. The air bladder may preferably, but need not necessarily, be adapted for ready positioning inside the boat under the boat cover and/or for ready removal therefrom.

According to an aspect of the invention, the airline may preferably, but need not necessarily, have a diameter that fits, under the boat cover, between the boat cover and the boat.

According to an aspect of the invention, preferably when the pump is operated as aforesaid, the air bladder may preferably, but need not necessarily, be selectively inflated and/or the top portion may preferably, but need not necessarily, be raised—preferably together with the boat cover—to a selected height to provide the boat cover with a selected tautness.

According to an aspect of the invention, the air bladder may preferably, but need not necessarily, be further adapted to first, in a substantially deflated configuration, be positioned inside the boat with the airline extending outside the boat when the boat cover is removed from the boat—that is, preferably before the boat cover is readily secured over the boat, and/or preferably before the pump is then operated as aforesaid to selectively inflate the air bladder with the boat cover secured over the boat.

According to an aspect of the invention, the pump nozzle may preferably, but need not necessarily, be further adapted to be readily disconnected from, and/or to be reconnected with the pump outside the boat preferably while the boat cover is secured over the boat preferably, thus, to selectively reinflate the air bladder to maintain the boat cover with a selected tautness preferably while the boat cover is secured over the boat.

According to an aspect of the invention, the air bladder may preferably, but need not necessarily, be adapted to, in a substantially deflated configuration, be readily removed from the boat and/or transported.

According to an aspect of the invention, the air bladder may preferably, but need not necessarily, have a base portion with a bottom surface that may preferably, but need not necessarily, be substantially flat. The bottom surface may preferably, but need not necessarily, be adapted to securely engage a deck of the boat. The airline may preferably, but need not necessarily, extend over a wall of the boat to outside the boat.

According to an aspect of the invention, the base portion may preferably, but need not necessarily, be weighted to bias the air bladder towards an upright configuration when inflated.

According to an aspect of the invention, the device may preferably, but need not necessarily, be further adapted for use with a deck of the boat when the deck may be shaped to define a floor cavity therein. The air bladder may preferably, but need not necessarily, have a base portion that may preferably, but need not necessarily, be adapted to securely engage the deck of the boat within the floor cavity. The device may preferably, but need not necessarily, also include a removable floor cover that may preferably, but need not necessarily, be adapted to securely cover the floor cavity. The air bladder may preferably, but need not necessarily, be adapted to be securely stored within the floor cavity under the removable floor cover.

According to an aspect of the invention, the device may preferably, but need not necessarily, also include one or more support straps securely engaging the air bladder. The support straps may preferably, but need not necessarily, be adapted to also securely engage one or more tie-down connection points integrally provided on the boat, preferably to help keep the air bladder upright when in an inflated configuration.

According to an aspect of the invention, the device may preferably, but need not necessarily, also include a pole base member, and/or one or more mechanical telescoping poles securely engaging the air bladder and/or the pole base member, preferably to help keep the air bladder upright when in an inflated configuration.

According to an aspect of the invention, the air bladder may preferably, but need not necessarily, have a substantially flat base portion with a bottom surface that may preferably, but need not necessarily, be adapted to securely engage a deck of the boat. The base portion may preferably, but need not necessarily, be weighted to bias the air bladder towards an upright configuration when inflated. The device may preferably, but need not necessarily, also include an internal telescopic mechanism, preferably inside the internal air chamber, that may preferably, but need not necessarily, engage the top portion and/or the base portion inside the internal air chamber, preferably to help keep the air bladder upright when in an inflated configuration.

According to the invention, there is also disclosed a jack system for preferable use with a removable cover secured over a boat (or trailer, etc.) and/or with a power supply outside the boat (or trailer, etc.). The device may preferably include a pump, an air bladder, an airline, and/or a two-way valve. The pump may preferably be adapted to be positioned outside the boat and/or powered by the power supply. The air bladder may preferably be selectively inflatable and/or deflatable. It may preferably have a top portion, and/or be shaped to define an internal air chamber. The air bladder may preferably be adapted to be securely positioned inside the boat under the boat cover. The airline may preferably have a pump nozzle, and/or be connected to the air bladder in fluid communication with the internal air chamber to inflate and/or deflate the air bladder. The pump nozzle may preferably be connected to the pump for fluid communication of air from the pump to the internal air chamber preferably, thus, to selectively inflate the air bladder when the boat cover may preferably be secured over the boat. The two-way valve may preferably be provided on the airline. The two-way valve may preferably be readily and/or selectively controllable and/or positionable either (i) to deflate the air bladder, and/or (ii) to permit fluid communication of air from the pump through the airline to the internal air chamber. The two-way valve provided on the airline may preferably be adapted to be positioned outside the boat preferably, thus, to permit ready and/or selective control of the two-way valve from outside the boat. Preferably, when the pump is operated and/or the two-way valve may preferably be positioned to permit the aforesaid fluid communication of air from the pump through the airline to the internal air chamber, the air bladder may preferably be inflated and/or the top portion of the air bladder may preferably engage an underside of the boat cover and/or pull the boat cover taut over the boat preferably, thus, to help minimize and/or protect against water pooling on the boat cover.

According to an aspect of the invention, the pump may preferably, but need not necessarily, be a mechanical and/or electrical pump.

According to the invention, there is also disclosed a device, system, and/or method that substantially eliminates, minimizes, and/or reduces installation issues that otherwise may be confronted, and is preferably very portable and cost effective.

According to an aspect of the invention, an inflatable cylinder (herein, alternately referred to as an "air bladder") is provided. In a substantially deflated configuration, the cylinder may preferably, but need not necessarily, be positioned under the cover as the cover snapped into place. The cover may preferably be readily and/or easily snapped into place with the cylinder substantially deflated as aforesaid. An inflating line may preferably, but need not necessarily, extend from the cylinder towards an outside of a boat (or trailer, etc.), preferably to allow inflation with the cover already in place. According to one aspect of the invention, installation of a cover with a substantially taut surface may be substantially easier, preferably by allowing control of the device, system, and/or method to take place from outside of the boat or trailer, etc. After the cover has been pulled substantially taut, the inflating may preferably stop.

According to an aspect of the invention, the inflatable cylinder inside a covered boat (or trailer, etc.) can be readily and/or easily inflated without needing to touch the cover at all, at almost any time during storage, should water pooling be observed (e.g., due to weather changes). Preferably, after the cylinder has deflated or substantially deflated, it can be readily and/or easily transported and/or stored.

Other advantages, features and characteristics of the present invention, as well as methods of operation and functions of the related elements of the structure, and the combination of parts and economies of manufacture, will become more apparent upon consideration of the following detailed description with reference to the accompanying figures, the latter of which are briefly described hereinbelow.

BRIEF DESCRIPTION OF THE DRAWINGS

The novel features which are believed to be characteristic of the device, system and method according to the present invention, as to its structure, organization, use and method of operation, together with further objectives and advantages thereof, will be better understood from the following figures in which a presently preferred embodiment of the invention will now be illustrated by way of example. It is expressly understood, however, that the figures are for the purpose of illustration and description only, and are not intended as a definition of the limits of the invention. In the accompanying figures.

DETAILED DESCRIPTION OF PREFERRED EMBODIMENTS

Figure 1:
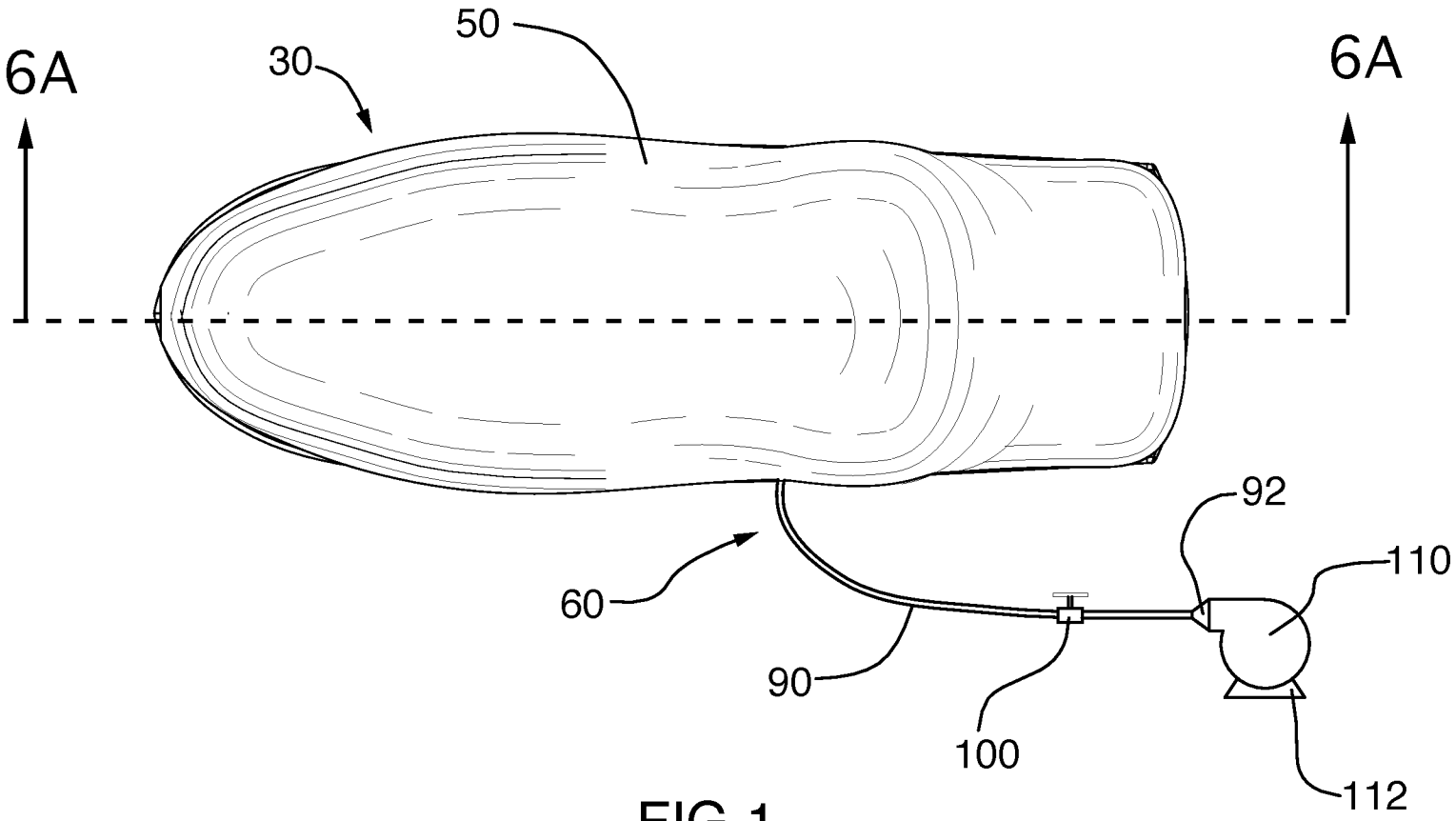
FIG. 1 is a top plan view of a covered boat, showing a device according to a preferred embodiment of the invention extending to outside of the covered boat.
Figure 2:
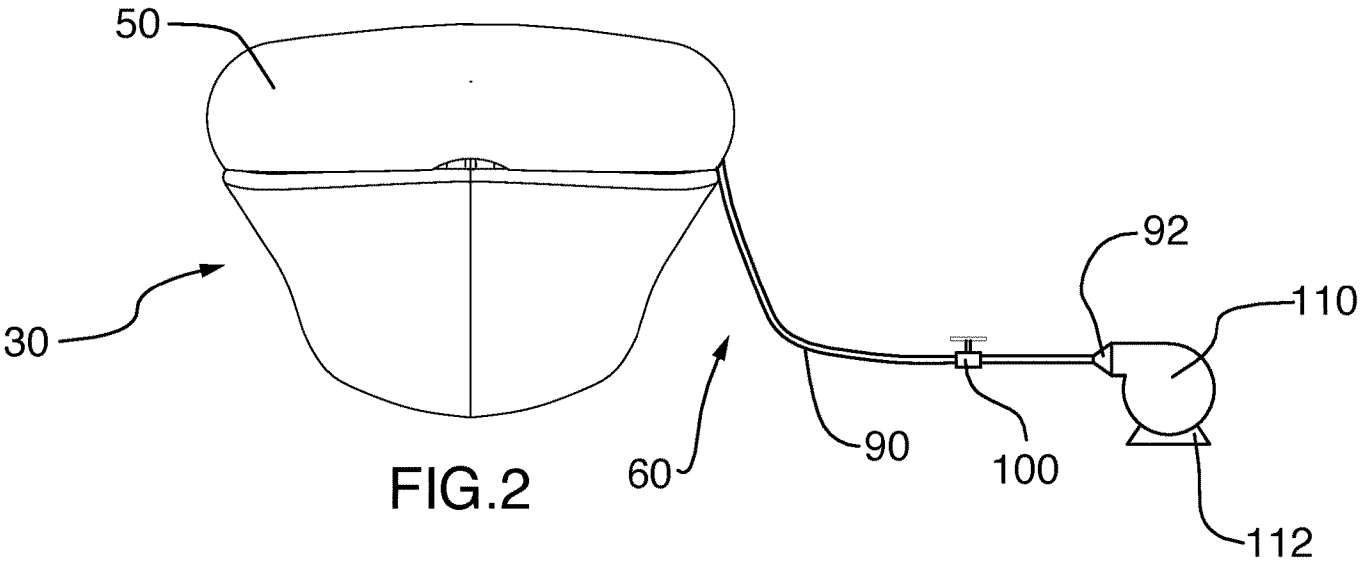
FIG. 2 is a front elevational view of the covered boat and device of FIG. 1.
Figure 3:
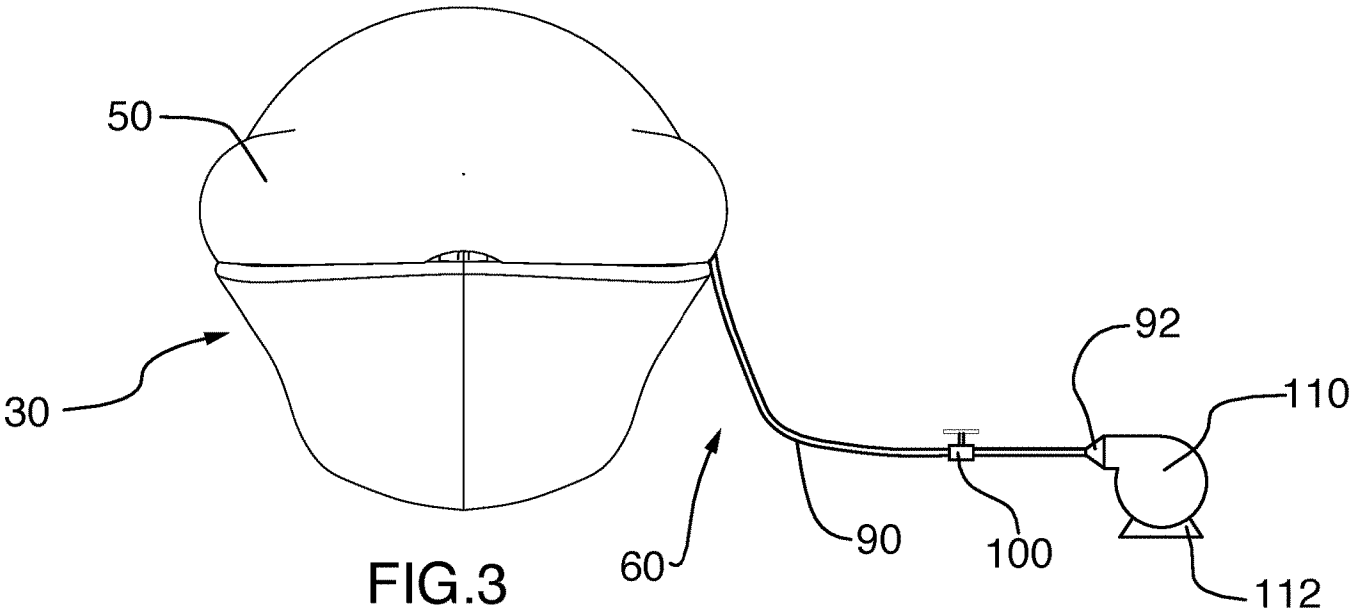
FIG. 3 is a front elevational view of the covered boat and device of FIG. 1, shown with an internal air bladder of the device inflated according to the invention.
Figure 4:
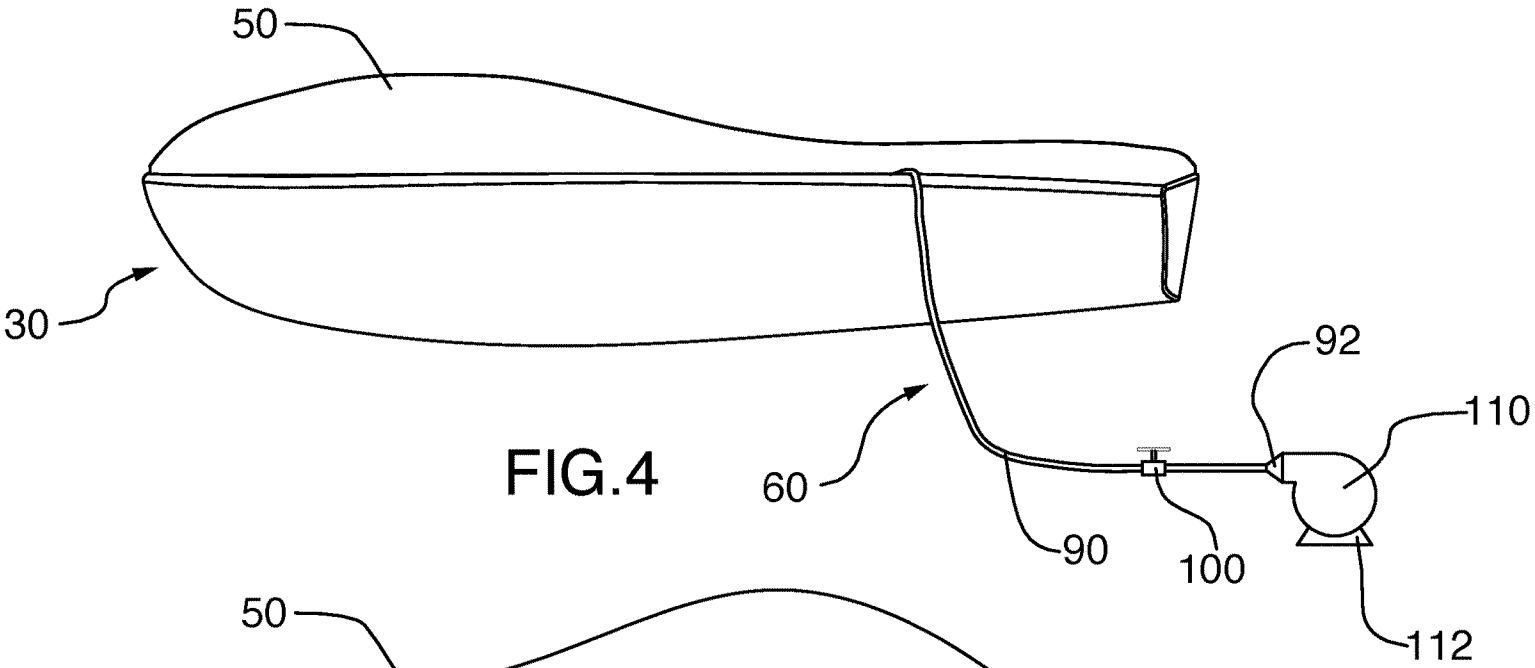
FIG. 4 is a left side elevational view of the covered boat and device of FIG. 1.
Figure 5:
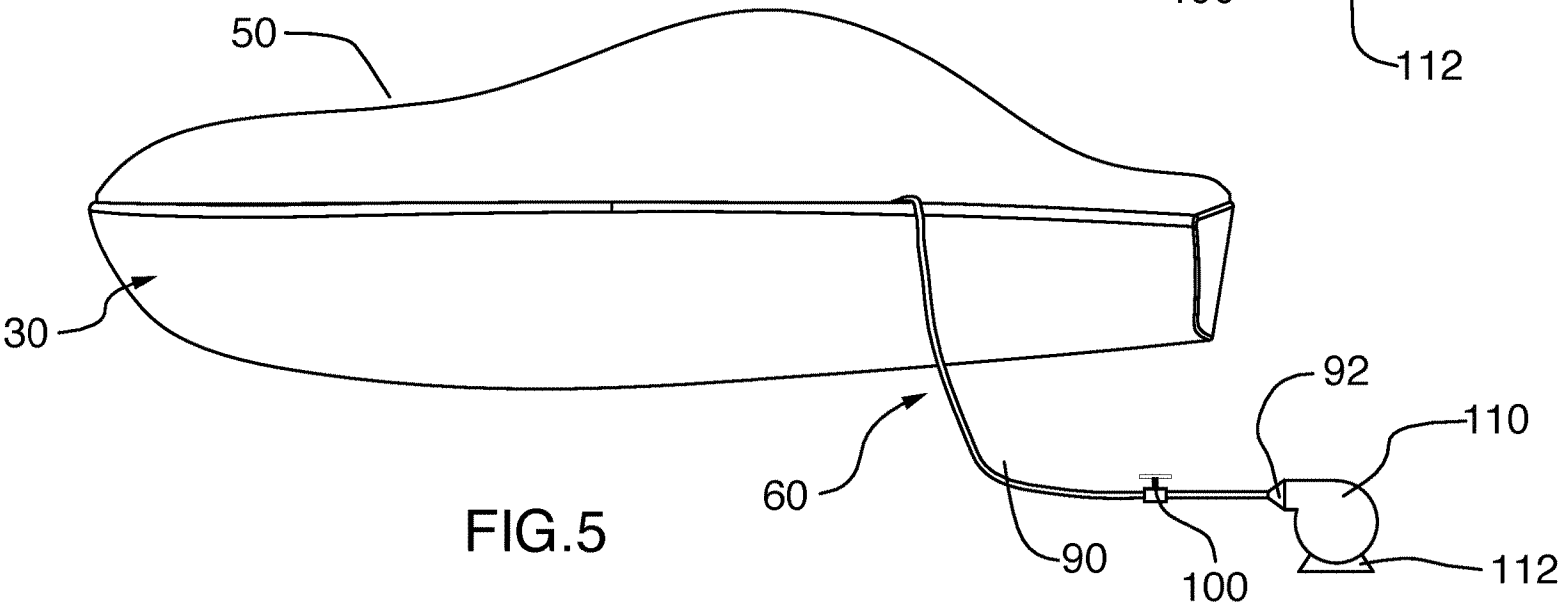
FIG. 5 is a left side elevational view of the covered boat and device of FIG. 3.

There is shown in accompanying FIGS. 1-17B preferred embodiments of a jack device 60 and system 60, 110 for pulling boat covers 50 taut and protecting against water pooling according to the invention. These figures also depict a method for pulling boat covers taut and protecting against water pooling according to the invention. The device 60 and system 60, 110 preferably provide an inflatable cylinder or air bladder 70. When in a deflated configuration, the cylinder 70 is preferably positioned under a boat (or trailer, etc.) cover 50 as the cover 50 is snapped into place. The cover 50 is preferably readily and easily snapped into place when the cylinder 70 is deflated. The device 60 preferably includes an inflating line or airline 90 that extends from the cylinder 70 to outside the boat 30 (or trailer 40, etc.) and allows the cylinder 70 to be inflated when the cover 50 is already in place. The cover 50 can preferably be pulled substantially taut and the device 60 can be controlled from outside the boat 30 (or trailer 40, etc.). After the cover 50 has been pulled substantially taut, the inflating will preferably stop.

Preferably, the inflatable cylinder 70 inside the covered boat 30 (or trailer 40, etc.) can be readily and easily inflated without needing to touch the cover 50 at all, at almost any time during storage—e.g., if water pooling is observed due to weather changes. Preferably, after the cylinder 70 has been deflated, it can be readily and easily transported and stored.

Figure 17B:
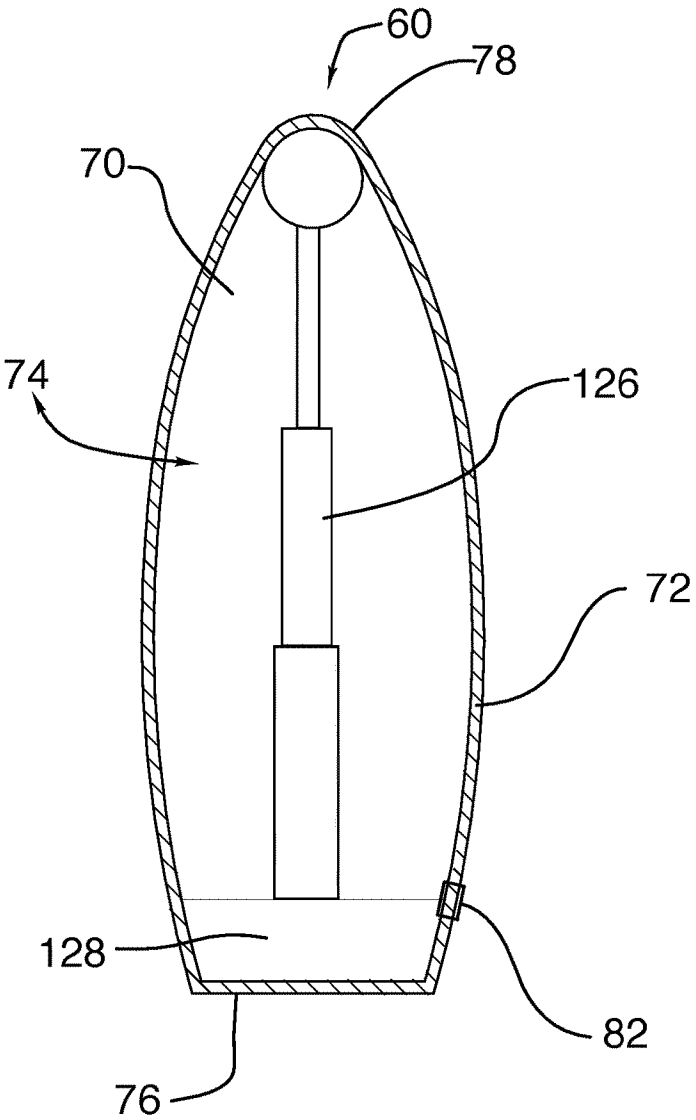
FIG. 17B is a partially sectional side view of another air bladder shown with an internal telescopic mechanism according to another embodiment of the invention.
Figure 17A:
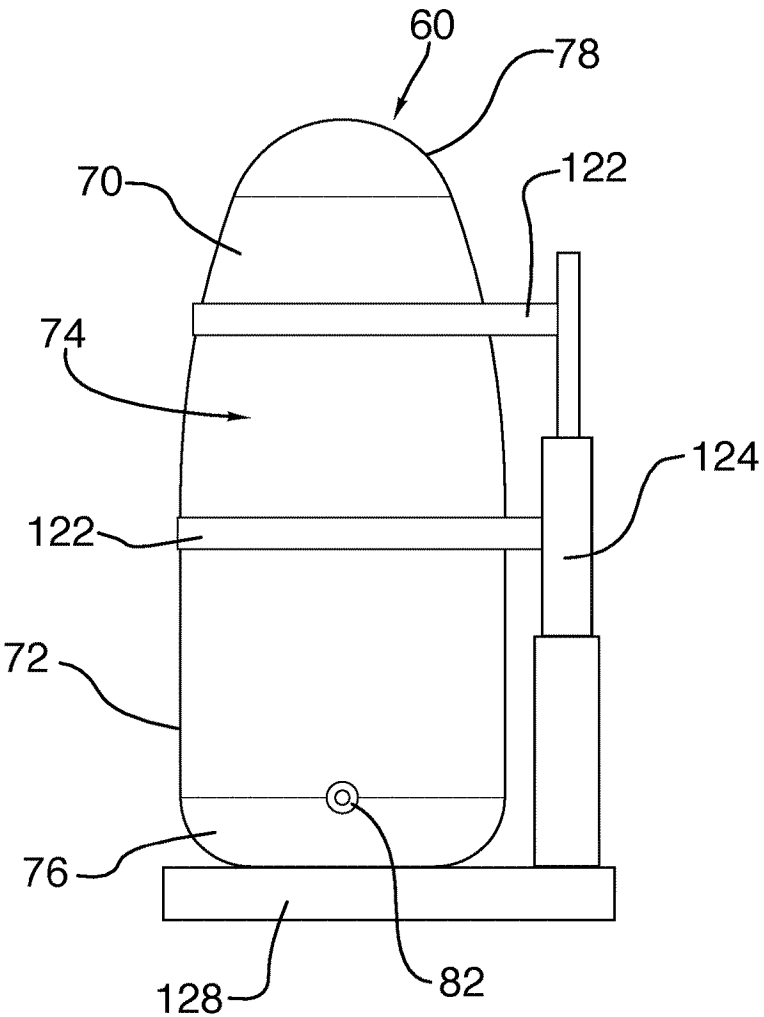
FIG. 17A is a side elevational view of another air bladder shown with a mechanical telescoping pole and a pole base member according to another embodiment of the invention.

The system 60, 110 preferably includes or provides: (a) an inflatable cylinder 70; (b) a connecting hose or airline 90; (c) a two-way valve 100; (d) a pump 110; and (e) one or more cylinder support systems—for example, support straps 122 as shown in FIGS. 6A, 7A, 7B, 7D, and 8, a mechanical telescopic pole 124 as shown in FIG. 17A, and/or an internal telescopic mechanism 126 as shown in FIG. 17B.

(a) The inflatable cylinder 70, in some preferred embodiments of the invention, has a substantially flat base portion 76 on the bottom. The base portion 76 is preferably weighted to bias the cylinder 70 towards an upright configuration (as best seen in FIGS. 7A, 7B, 7D, and 16). A range of different sized cylinders 70 is preferably provided to, according to the invention, suit different size boats 30 and/or trailers 40.

(b) The connecting hose 90 is preferably adapted for use with a pump 110 that is external to the boat 30 or trailer 40. It preferably takes the form of a pneumatic line, in fluid communication with the cylinder 70, that runs from the cylinder 70 under the cover 50 to the outside of the boat 30 (or trailer 40, etc.), where it preferably can connect with the pump 110.

(c) The two-way valve 100 is preferably provided on the cylinder 70 (not shown) or on the hose 90, and in fluid communication therewith, to enable inflation or deflation of the cylinder 70 if, when, and required or desired.

(d) Preferably, the pump 110 may optionally be provided as part of the system 60, 110 and/or apart from the device 60. That said, a variety of pumps 110 will preferably work in association with the cylinder 70. Suitable pumps 110, according to some preferred embodiments of the invention, include mechanical pumps and electrical pumps. Electrical pumps may, for example, work with a variety of different power sources or power supplies 112, including batteries, 120V plug-ins, and/or 12V car plug-ins. (The jack system 60, 110 is for use with a power supply 112 outside the boat 30. The pump 110 is powered by the power supply 112.)

(e) The device 60 and system 60, 110 may optionally, in some preferred embodiments of the invention, include one or more cylinder support systems—for example, support straps 122 as shown in FIGS. 6A, 7A, 7B, 7D, and 8, a mechanical telescopic pole 124 as shown in FIG. 17A, and/or an internal telescopic mechanism 126 as shown in FIG. 17B. Depending on the size, style, and other aspects of a boat 30 (or trailer 40, etc.), such support systems may optionally be provided to help the inflated cylinder 70 stay upright, as shown in FIGS. 7A, 7B, 7D, 17A, and 17B. The support systems may, for example, include hook-and-loop (e.g., Velcro™) straps 122 that can secure the inflatable cylinder 70 to one or more cleats or other tie-downs 36 which may be integrally provided on the boat 30 (or trailer 40, etc.).

In use, the cylinder 70 is preferably positioned inside a boat 30 (or trailer 40, etc.) and under a cover 50 that is then snapped in place over the boat 30 (or trailer 40, etc.). The cylinder 70 is preferably positioned substantially in a center portion of an area where the cover 50 may be raised to prevent water from pooling on the cover 50. The external pump 110 is preferably used to inflate the cylinder 70 positioned under the cover 50 that is snapped in place. The pump 110 preferably inflates the cylinder 70 sufficiently to provide the cover 50 with a desired tautness.

The invention provides for a novel and ingenious use of an inflatable item or air bladder 70 to support a boat cover 50 and to enable them both to be controlled from outside the boat 30, e.g., by inflating and deflating the item 70 to respectively raise and lower the boat cover 50 to a required or desired height.

With the device 60, system 60, 110, and method according to the invention, users have ready external control over the tautness of the boat 30 (or trailer 40, etc.) cover 50 and better protection against water pooling and any damage that might otherwise occur. Preferably, the device 60, system 60, 110, and method according to the invention are easier to transport, install, use, and maintain than anything taught or disclosed in the prior art. The inflatable cylinder 70 can be simply positioned inside the boat 30 (or trailer 40, etc.) in a deflated or substantially deflated configuration, as shown in FIGS. 6A, 6B, 8, and 15. Then, the cover 50 can be easily lined up and snapped into place in the usual fashion without any inordinate effort or strain on the user or boat 30 (or trailer 40, etc.). And, afterwards, the cylinder 70 can be simply inflated from the outside to raise the cover 50 to the desired level.

During storage, if any water pooling is noticed, the user can easily reconnect a pump 110 externally and further inflate the cylinder 70 inside the boat 30 (or trailer 40, etc.) to make the cover 50 taut again.

As mentioned, the jack device 60 is for use with a removable boat cover 50 secured over a boat 30 and with a pump 110 outside the boat 30. The device 60 includes an air bladder 70, an airline 90, and a two-way valve 100. The air bladder 70 (alternately referred to as an "internal cylinder" 70) is selectively inflatable and deflatable. It has a top portion 78, and is shaped to define an internal air chamber 74. The air bladder 70 is securely positioned inside the boat 30 under the boat cover 50. The airline 90 has a pump nozzle 92. The airline 90 is connected to the air bladder 70, at an airline connection point 82, in fluid communication with the internal air chamber 74 to inflate and deflate the air bladder 70. The pump nozzle 92 is readily connected to the pump 110 outside the boat 30. The pump nozzle 92 and the airline 90 enable fluid communication of air from the pump 110 to the internal air chamber 74, thus, to selectively inflate the air bladder 70 when the boat cover 50 is secured over the boat 30. The two-way valve 100 is provided on the airline 90. The two-way valve 100 is readily and selectively controllable and positionable either (i) to deflate the air bladder 70, or (ii) to permit fluid communication of air from the pump 110 through the airline 90 to the internal air chamber 74. The two-way valve 100 on the airline 90 is positioned outside the boat 30, thus, to permit ready and selective control of the two-way valve 100 from outside the boat 30. When the pump nozzle 92 is connected to the pump 110 and the two-way valve 100 is positioned to permit fluid communication of air from the pump 110 through the airline 90 to the internal air chamber 74, when the pump 110 is operated, the air bladder 70 is inflated and the top portion 78 of the air bladder 70 engages an underside of the boat cover 50 and pulls the boat cover 50 taut over the boat 30, thus, to help minimize and protect against water pooling on the boat cover 50.

The air bladder 70, the airline 90, and the two-way valve 100 are readily portable. The air bladder 70 is readily positioned inside the boat 30 under the boat cover 50 and for ready removal therefrom. The airline 90 has a diameter that fits, under the boat cover 50, between the boat cover 50 and the boat 30.

When the pump 110 is operated as aforesaid, the air bladder 70 is selectively inflated and the top portion 78 is raised, together with the boat cover 50, to a selected height to provide the boat cover 50 with a selected tautness.

Figure 6A:
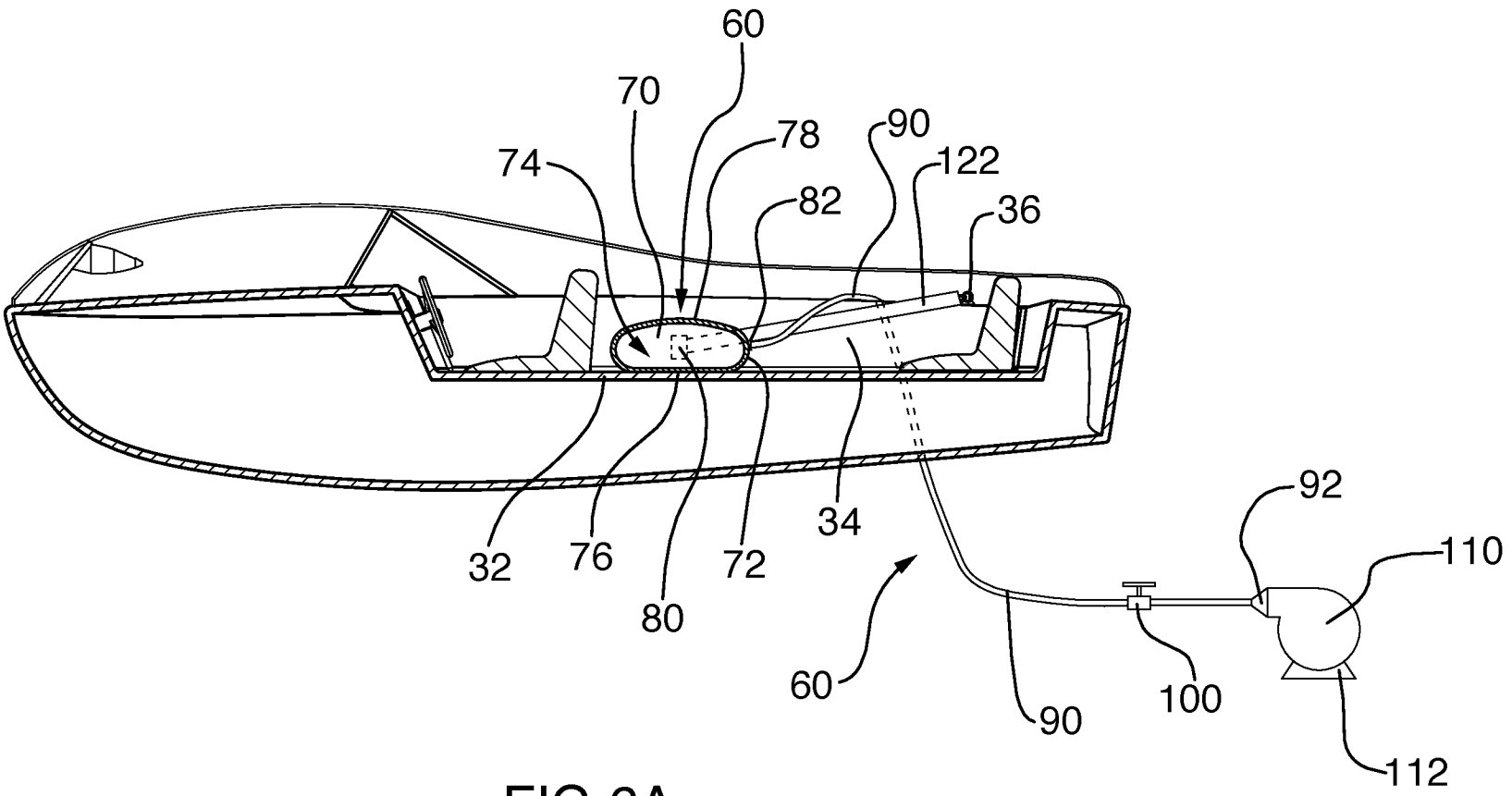
FIG. 6A is a partially sectional view of the covered boat, along section line 6A-6A, of FIG. 1, showing the internal air bladder according to the invention in an un-inflated configuration.
Figure 7A:
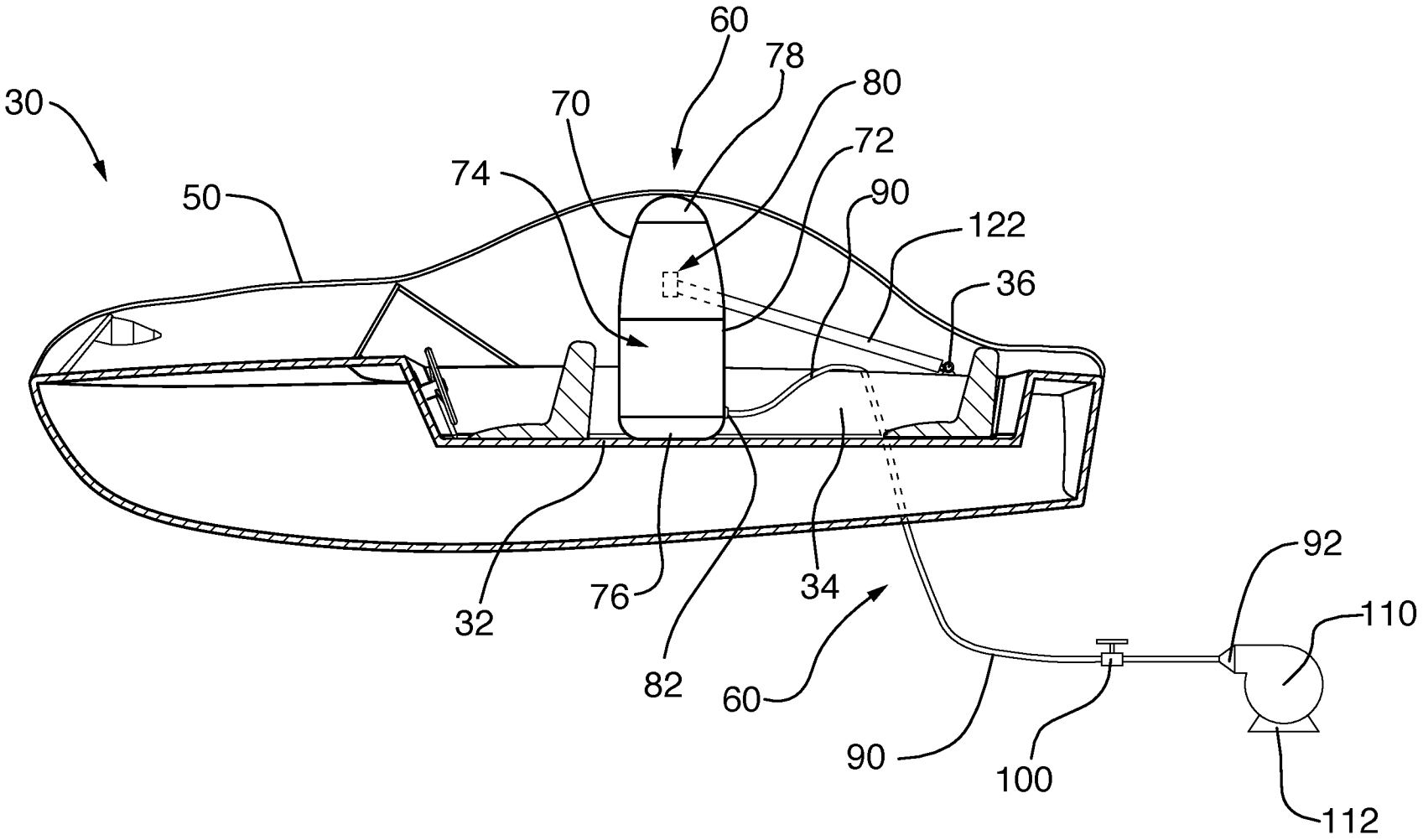
FIG. 7A is a partially sectional view of the covered boat and air bladder of FIG. 6A, showing the air bladder secured by rear straps in an inflated configuration.
Figure 8:
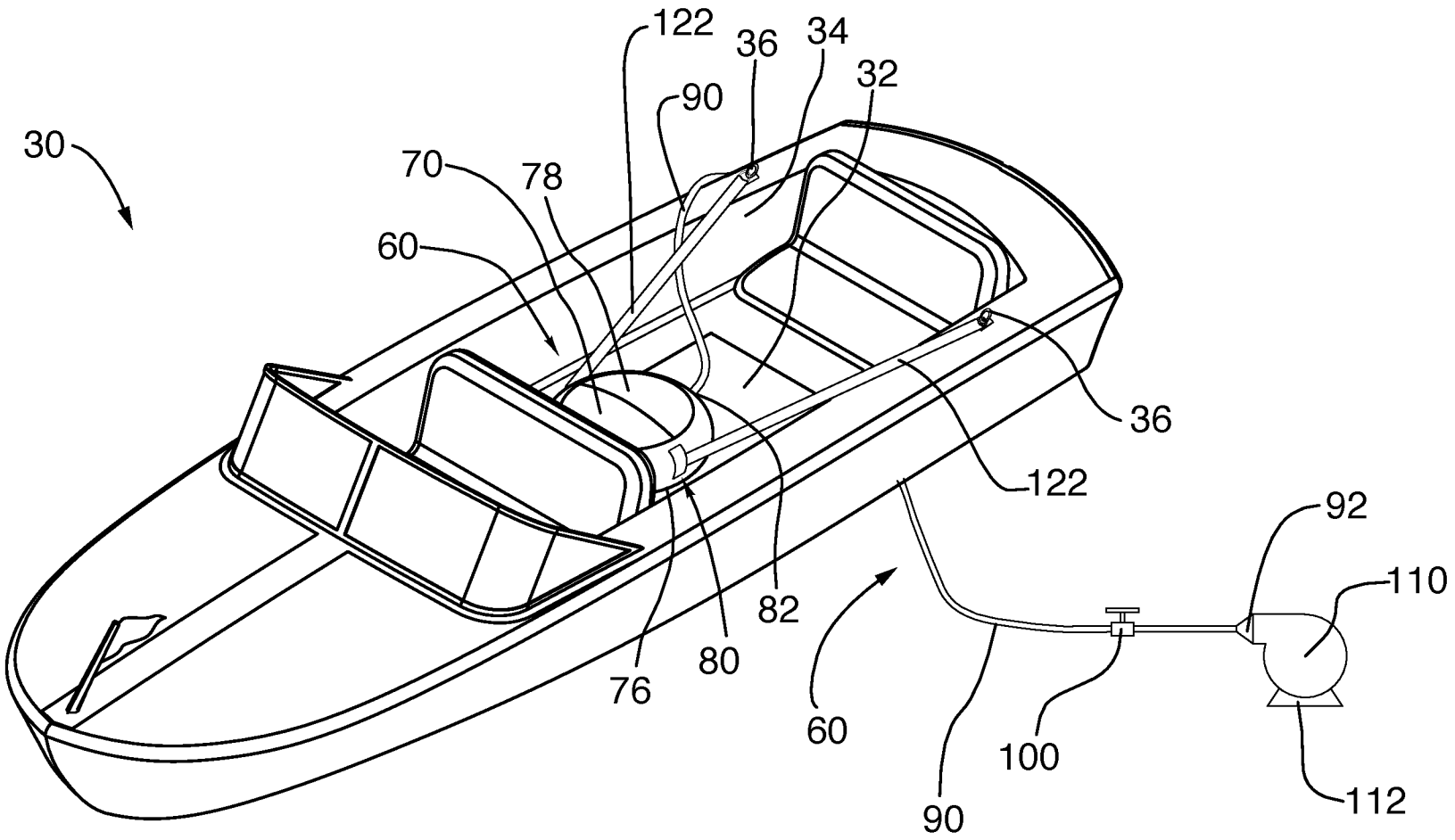
FIG. 8 is a top front left perspective view of the device and boat of FIG. 6A, shown without the cover.
Figure 9:
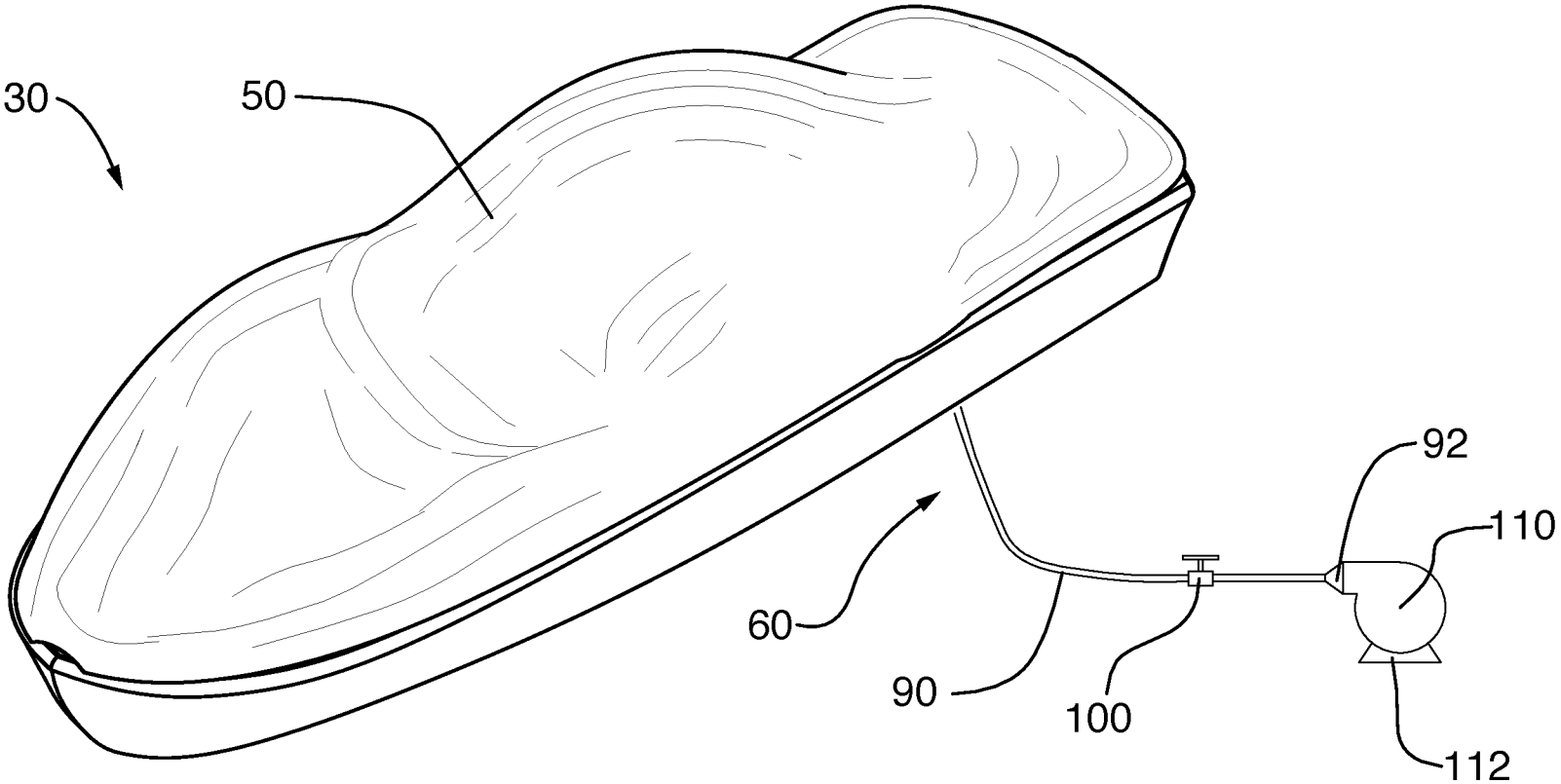
FIG. 9 is a top front left perspective view of the device and boat of FIG. 7A.
Figure 10:
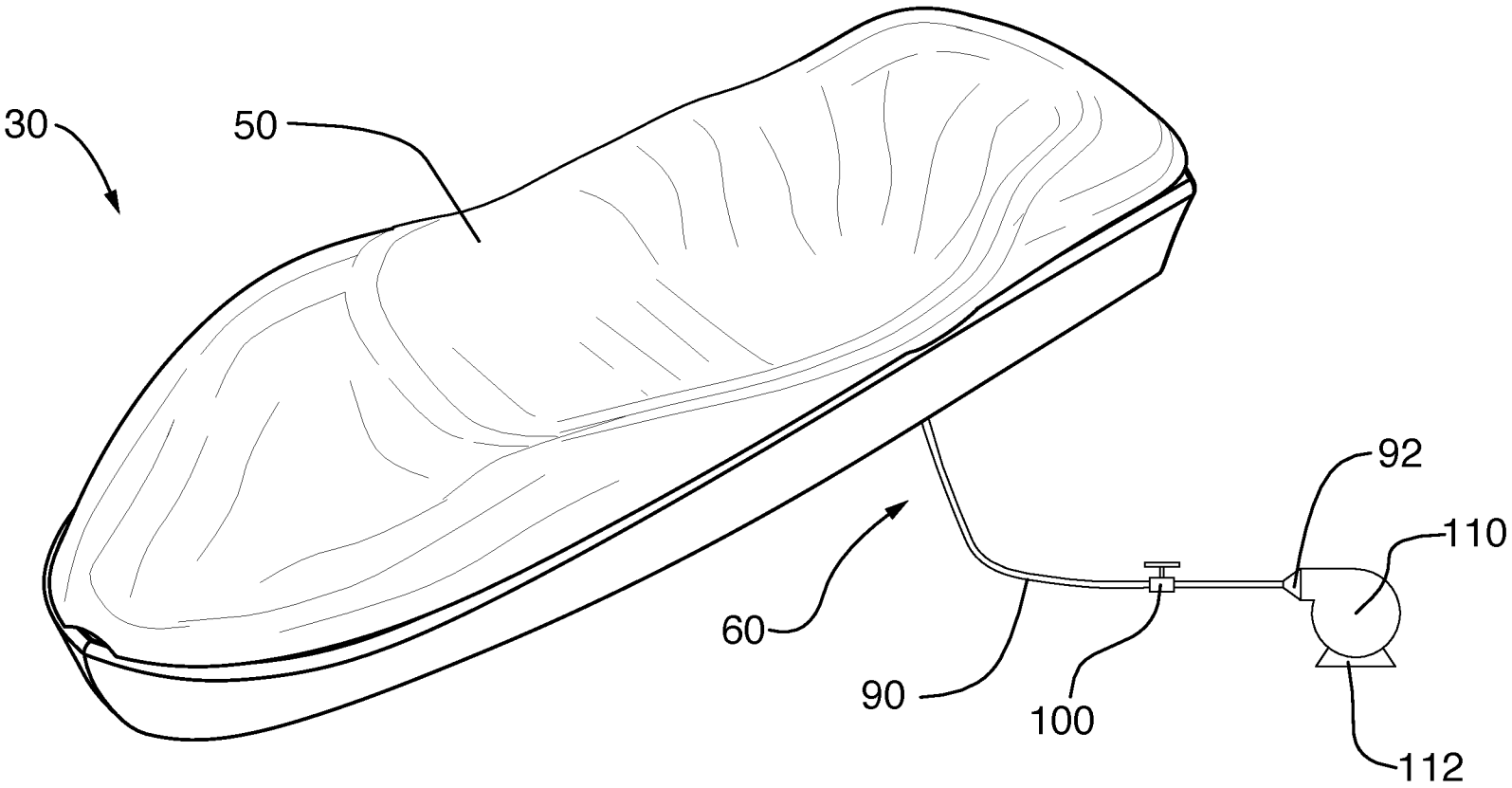
FIG. 10 is a top front left perspective view of the device and boat of FIG. 6A.
Figure 11:
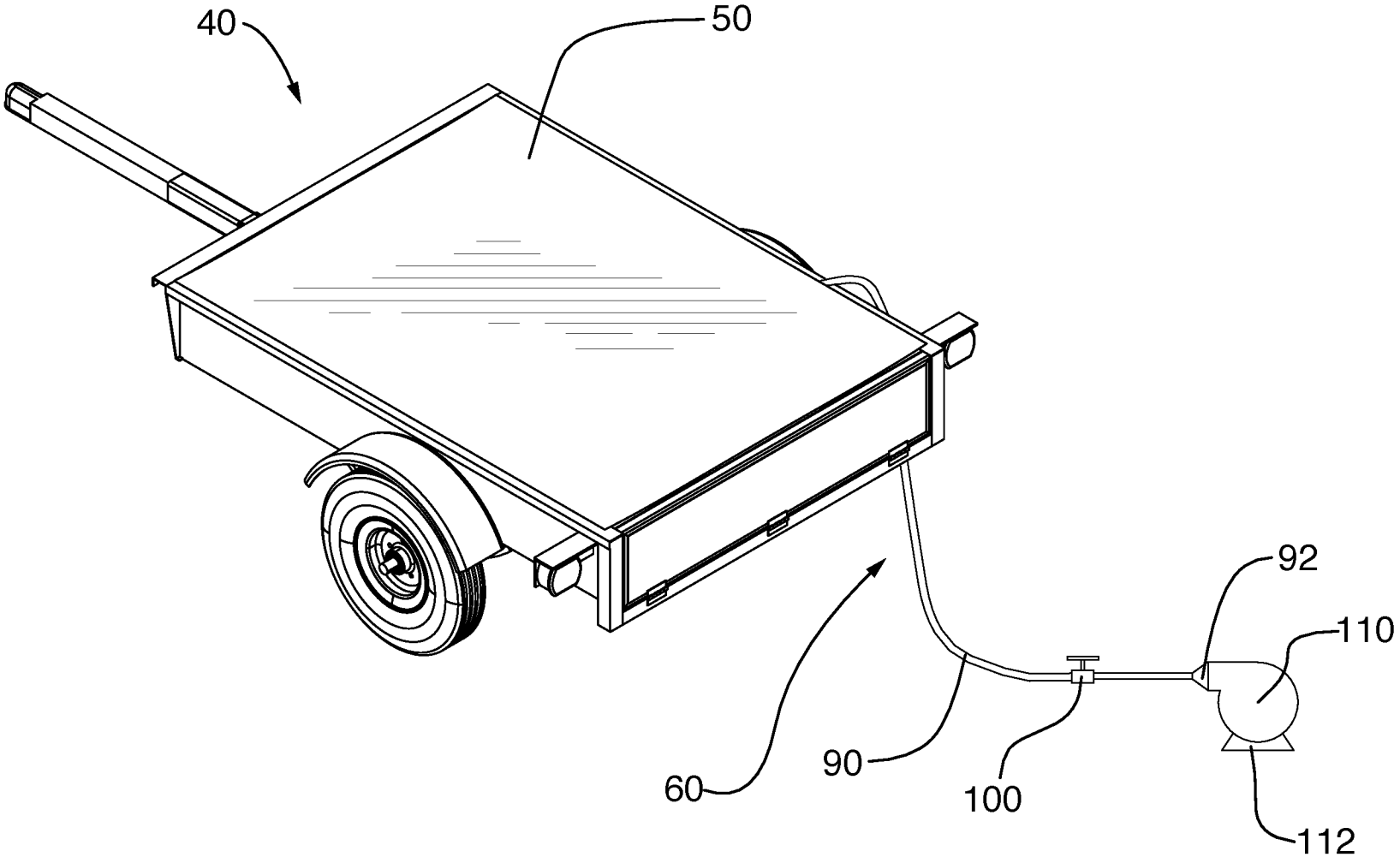
FIG. 11 is a top rear left perspective view of a covered trailer, showing a device according to a preferred embodiment of the invention extending to outside of the covered trailer.
Figure 12:
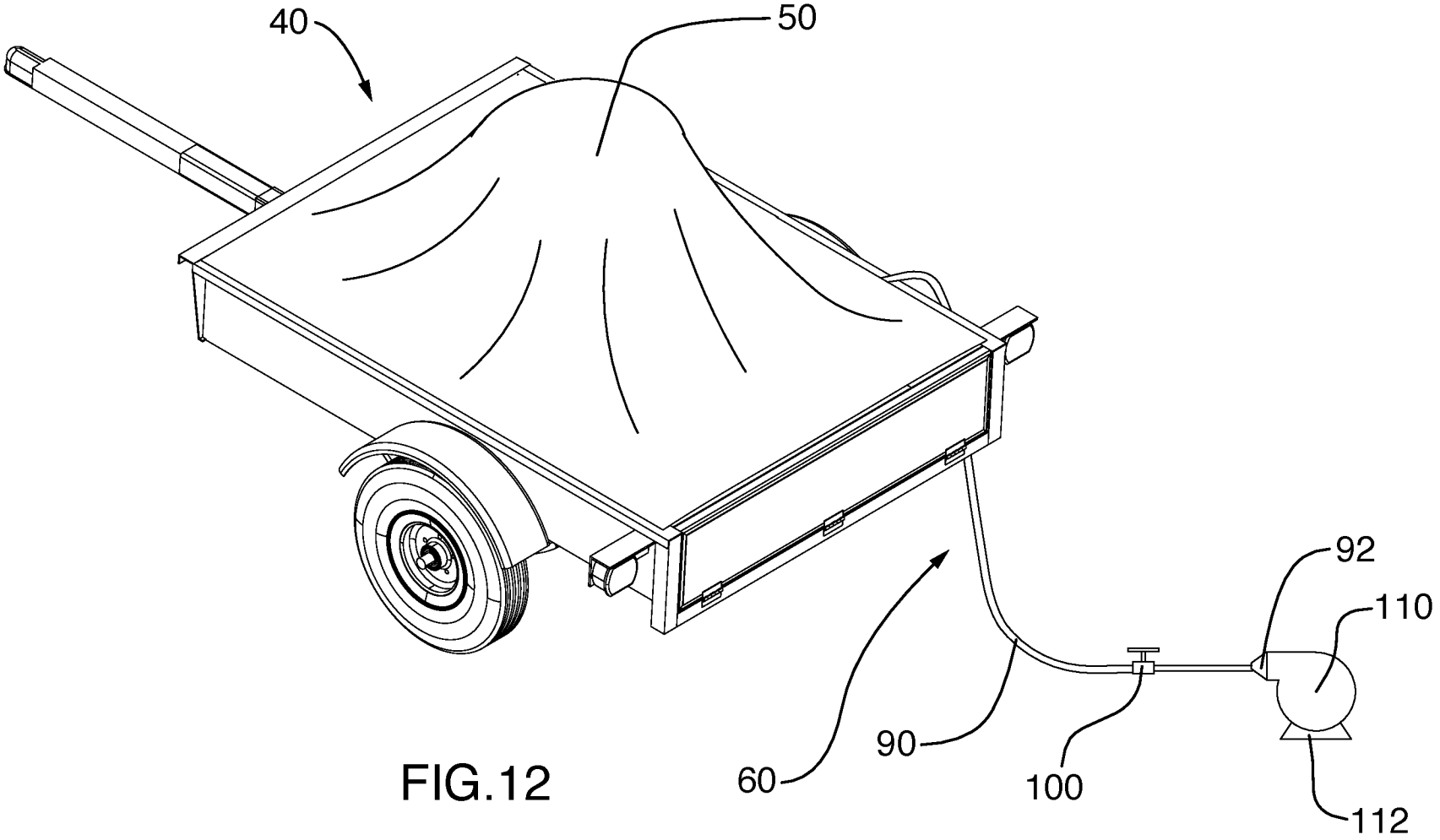
FIG. 12 is a top rear left perspective view of the covered trailer and device of FIG. 11, shown with an internal air bladder inflated according to the invention.
Figure 13:
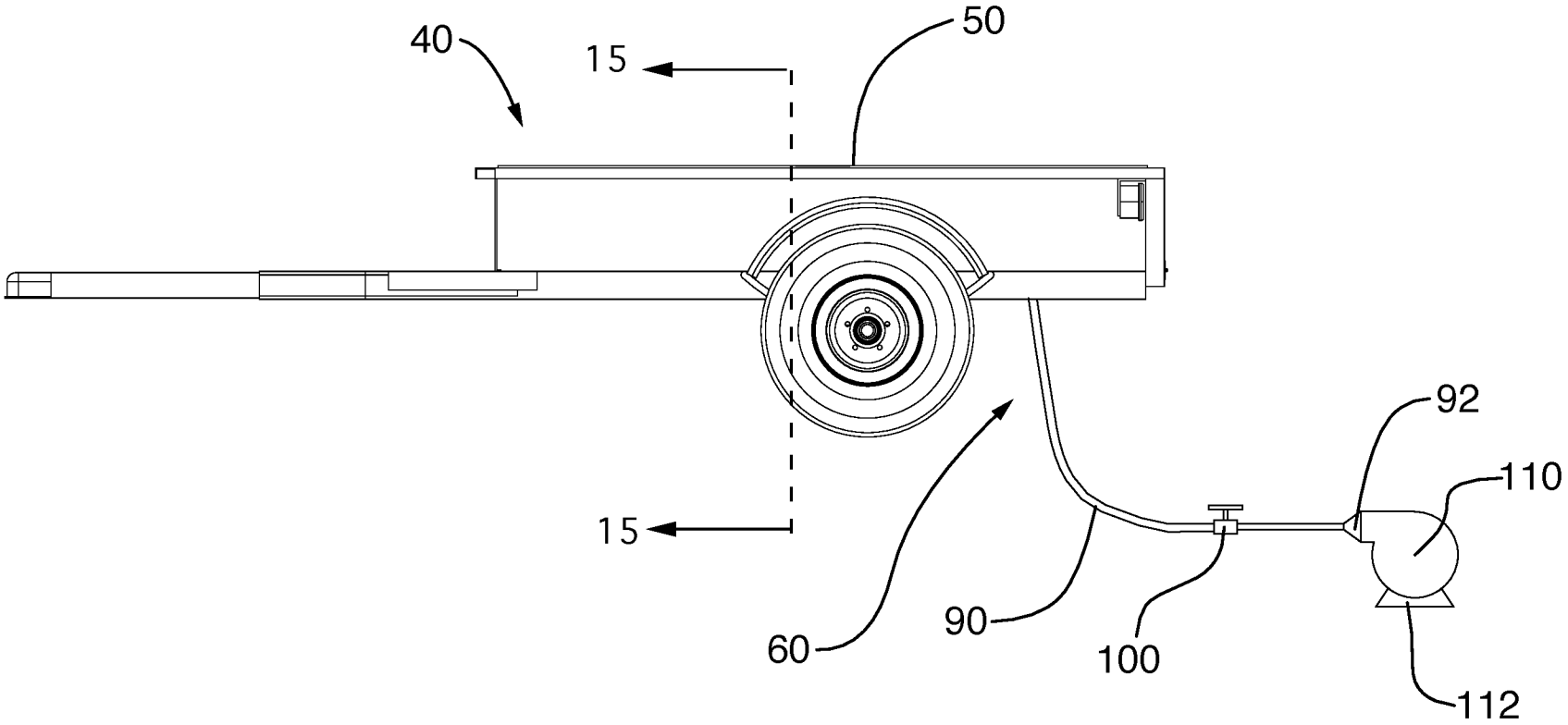
FIG. 13 is a left side elevational view of the covered trailer and device of FIG. 11.
Figure 14:
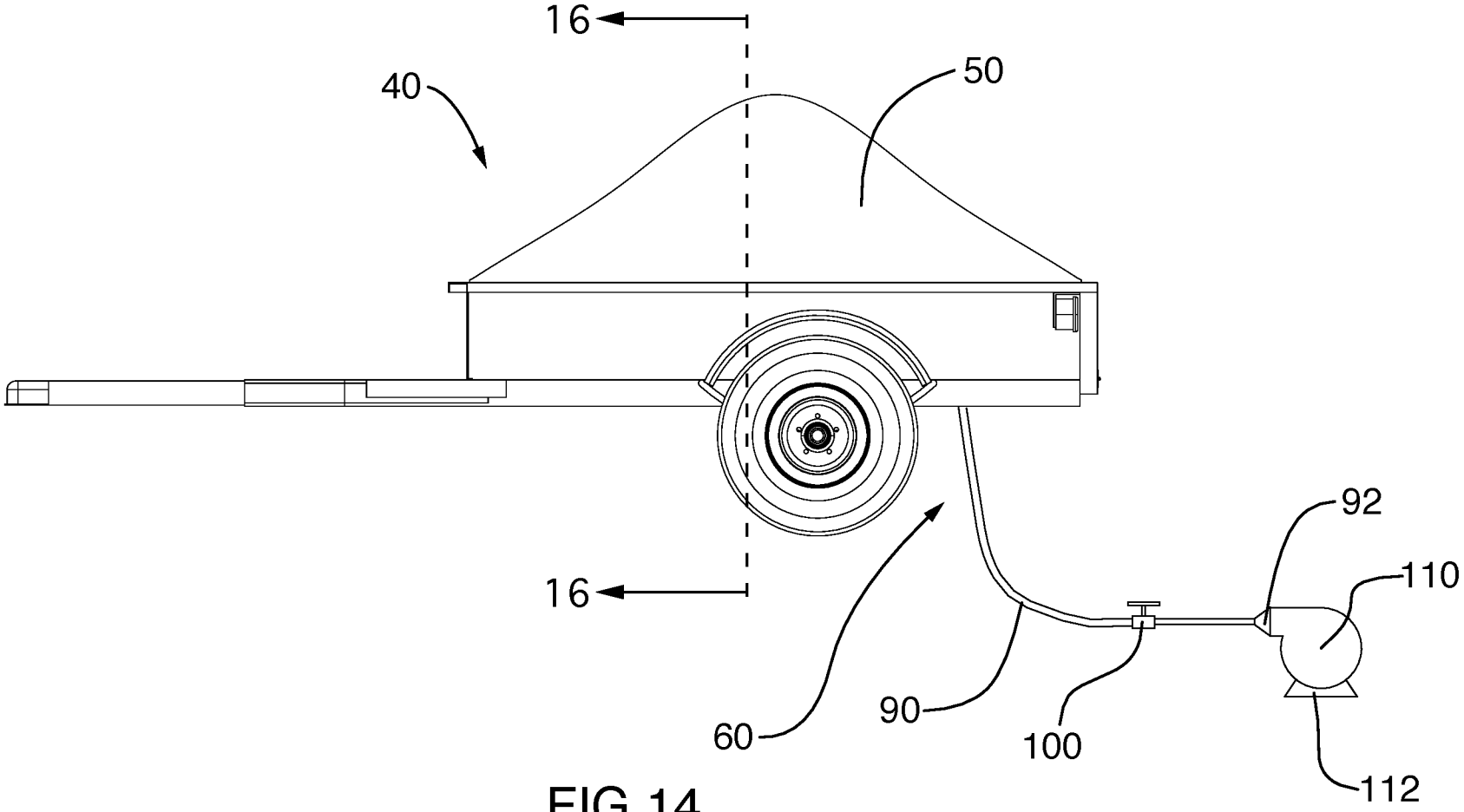
FIG. 14 is a left side elevational view of the covered trailer and device of FIG. 12.
Figure 15:
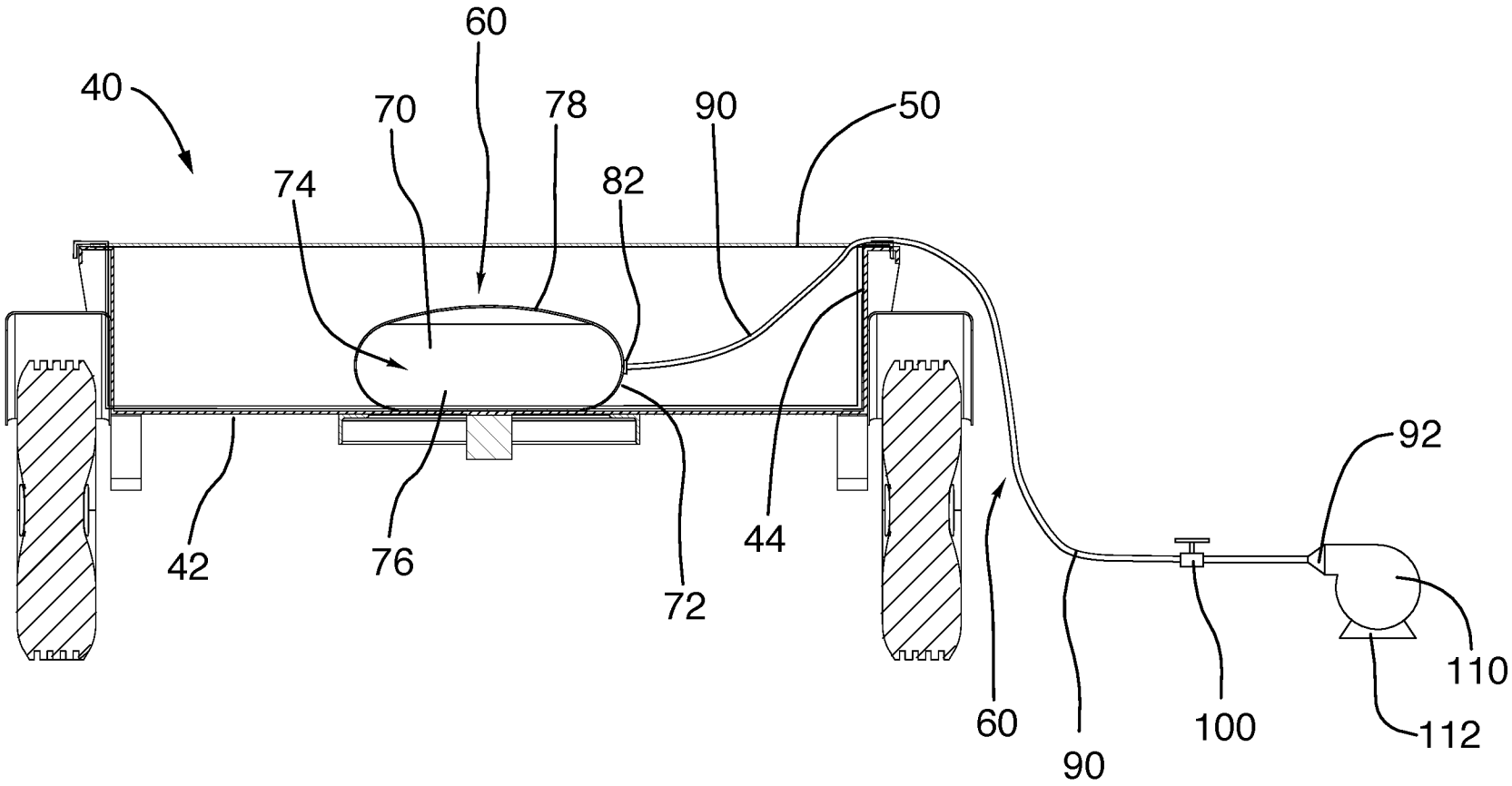
FIG. 15 is a partially sectional view of the covered trailer and device, along section line 15-15, of FIG. 13, showing an air bladder according to the invention in an un-inflated configuration.
Figure 16:
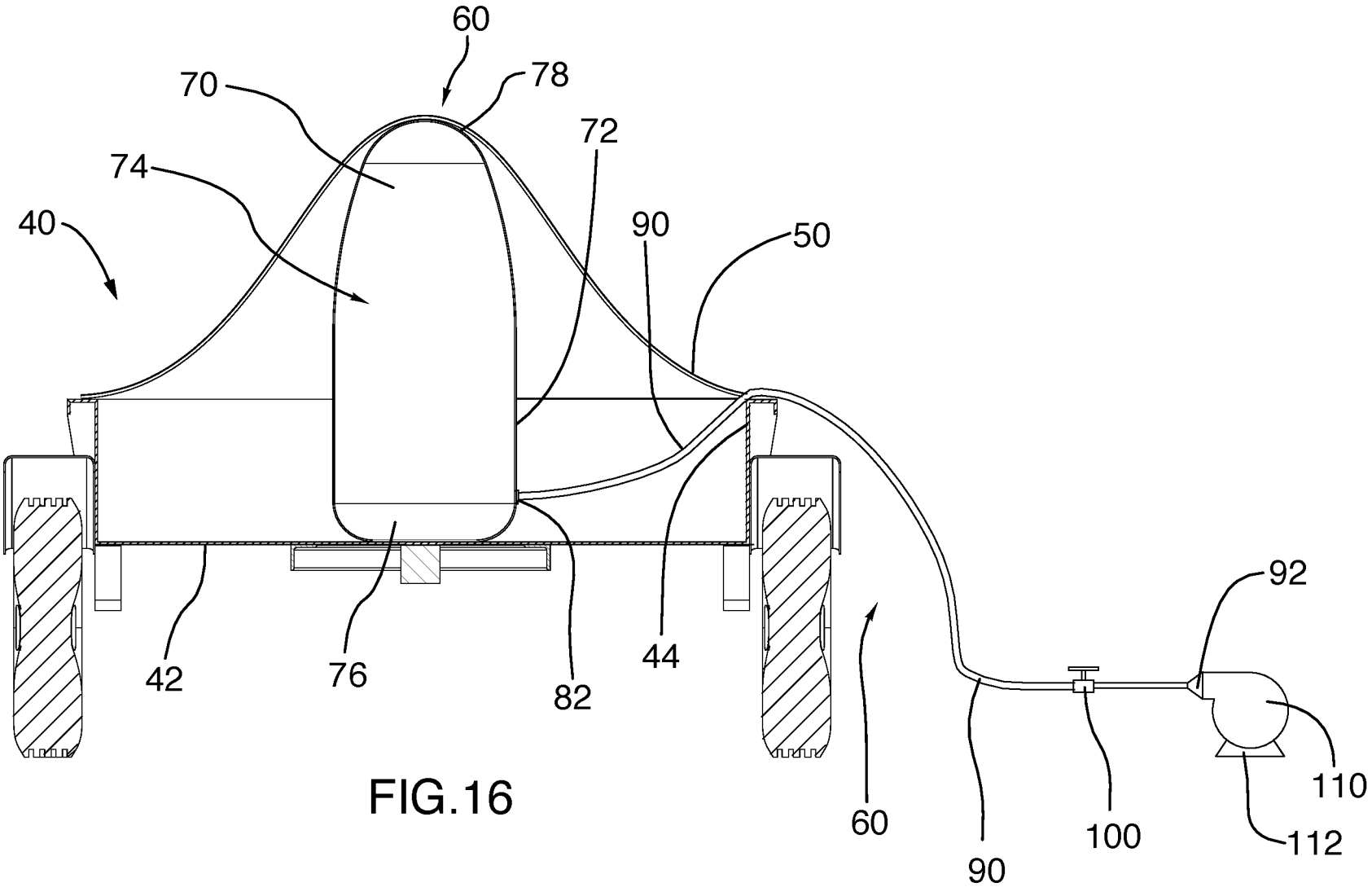
FIG. 16 is a partially sectional view of the covered trailer and device, along section line 16-16, of FIG. 14, showing the air bladder according to the invention in an inflated configuration.

The air bladder 70 is, in a substantially deflated configuration (as best seen in FIG. 8), first positioned inside the boat 30 with the airline 90 extending outside the boat 30 when the boat cover 50 is removed from the boat 30—that is, before the boat cover 50 is readily secured over the boat 30 (as shown in FIG. 6A), and before the pump 110 is then operated as aforesaid to selectively inflate the air bladder 70 with the boat cover 50 secured over the boat 30 (as shown, for example, in FIG. 7A).

The pump nozzle 92 can be readily disconnected from, and reconnected with the pump 110 outside the boat 30 while the boat cover 50 is secured over the boat 30, thus, to selectively reinflate the air bladder 70 to maintain the boat cover 50 with a selected tautness while the boat cover 50 is secured over the boat 30.

The air bladder 70 can, in a substantially deflated configuration (as best seen in FIG. 8), be readily removed from the boat 30 and transported.

The air bladder 70 has a base portion 76 with a bottom surface that is substantially flat. The base portion 76 is adapted to securely engage a deck 32 of the boat 30 (or the floor 42 of a trailer 40, etc.). The airline 90 extends over a gunwale or wall 34 of the boat 30 to outside the boat 30 (or over a wall 44 of the trailer 40 to outside the trailer 40). The base portion 76 is weighted to bias the air bladder 70 towards an upright configuration when inflated, as shown in FIGS. 7A, 7B, 7D, and 16.

Figure 6B:
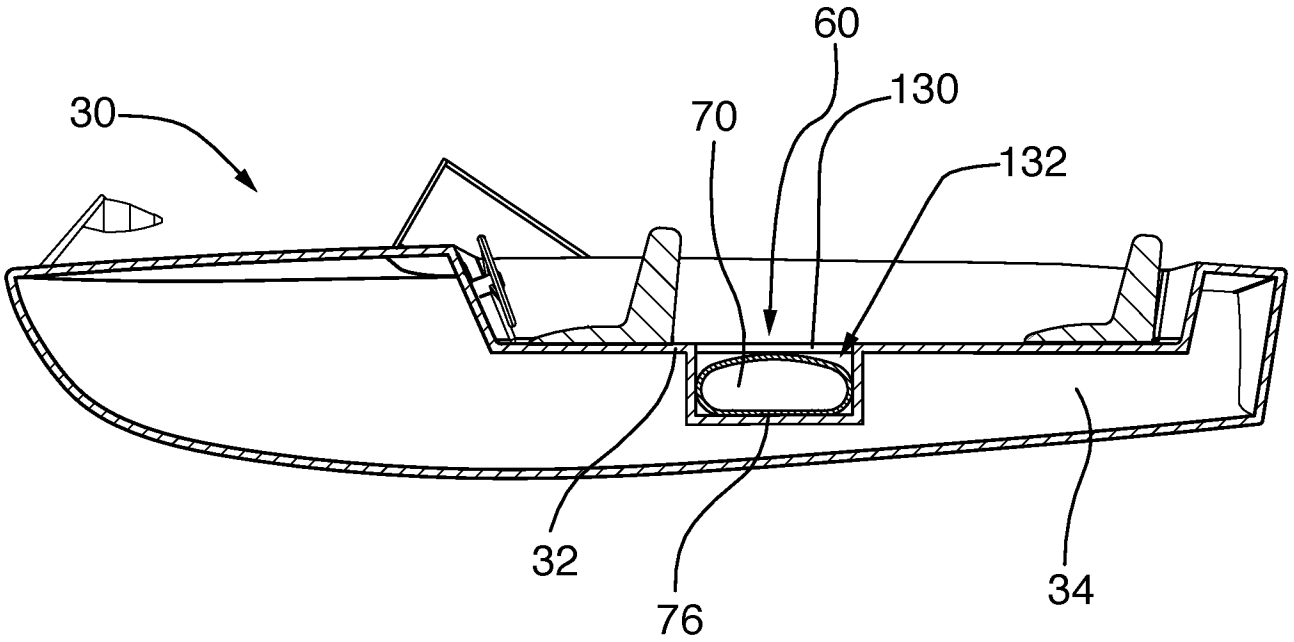
FIG. 6B is a partially sectional view of an internal air bladder stored, in an un-inflated configuration, within a floor cavity of an uncovered boat according to another embodiment of the invention.
Figure 7B:
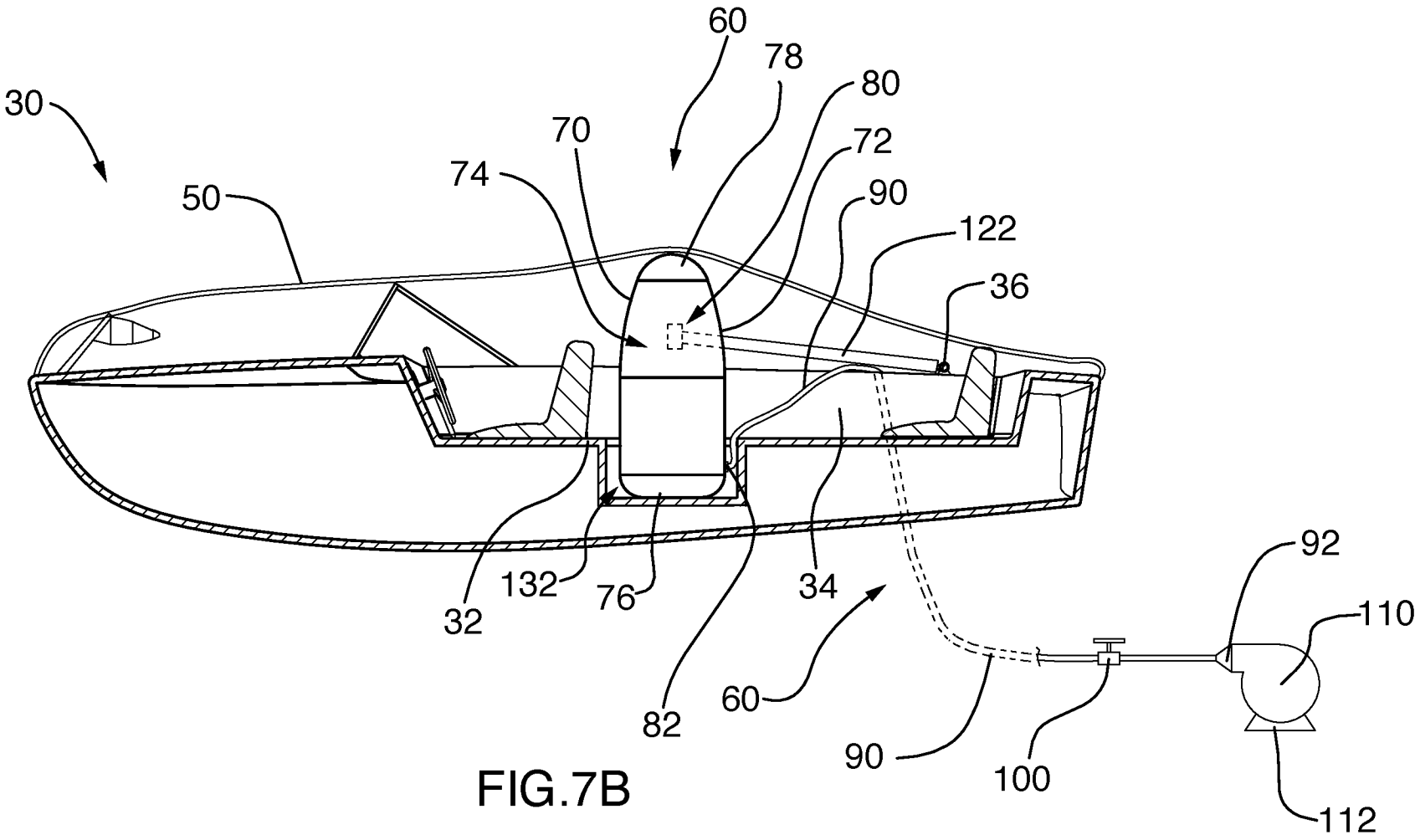
FIG. 7B is a partially sectional view of the air bladder of FIG. 6B, shown in an inflated configuration with a covered boat.
Figure 7C:
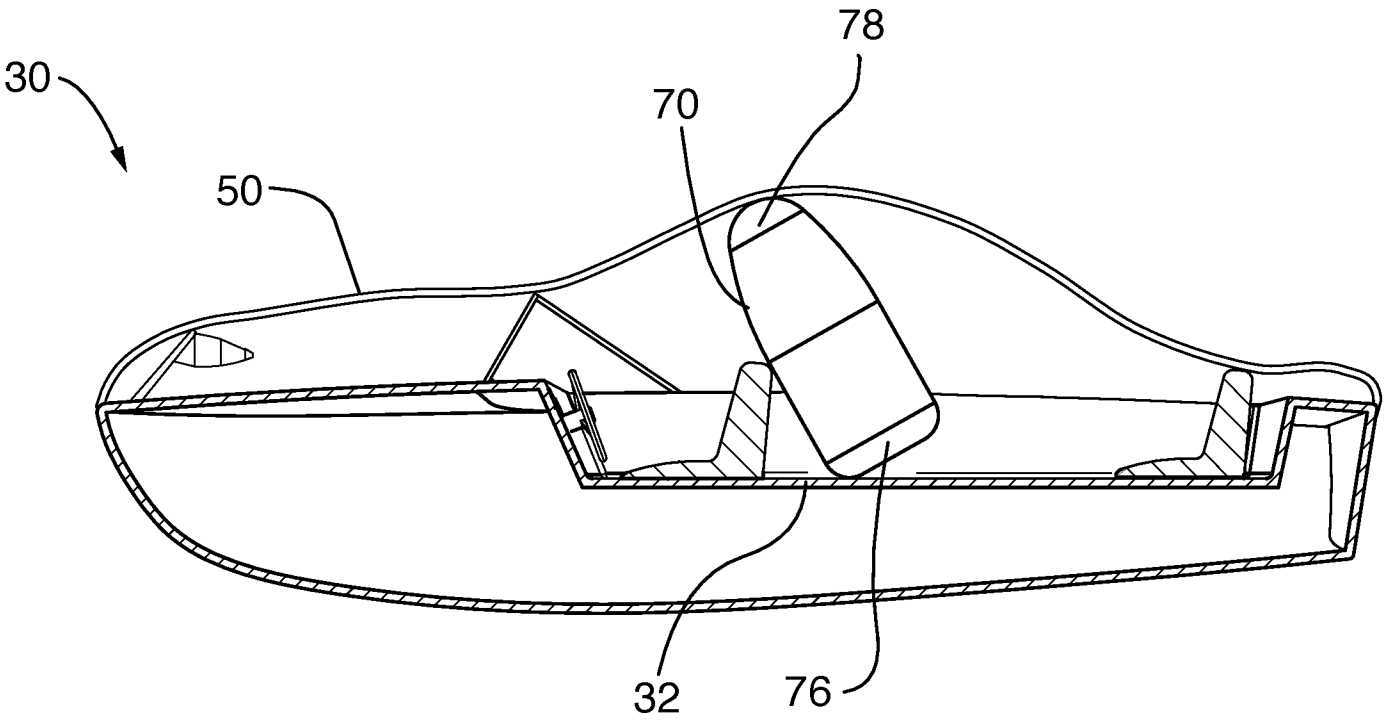
FIG. 7C is a partially sectional view of the covered boat and air bladder of FIG. 7A, shown without the rear straps, and showing the air bladder in a tipped-forward configuration.
Figure 7D:
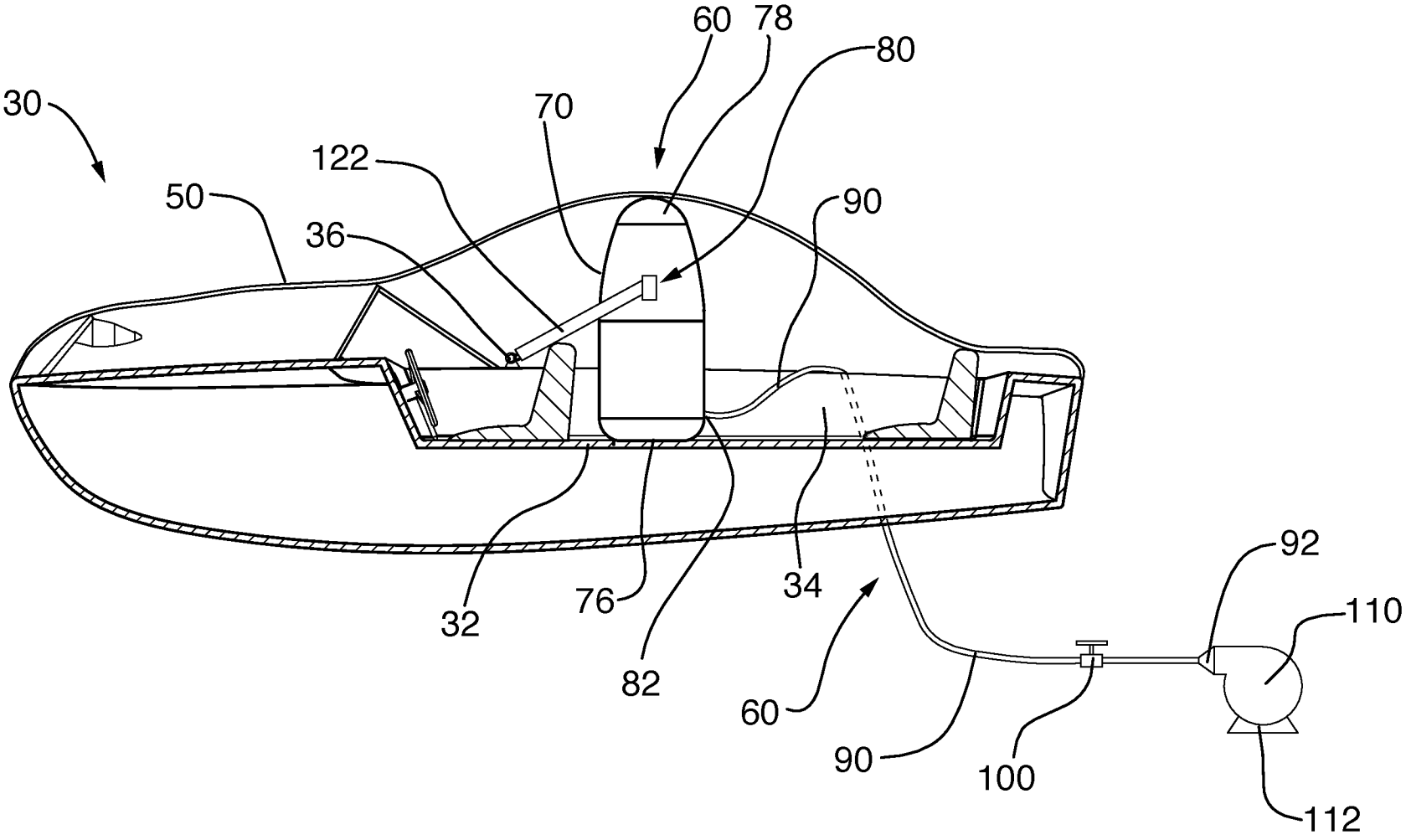
FIG. 7D is a partially sectional view of the covered boat of FIG. 1, showing the internal air bladder secured by front straps in an inflated configuration according to another embodiment of the invention.
Figure 7E:
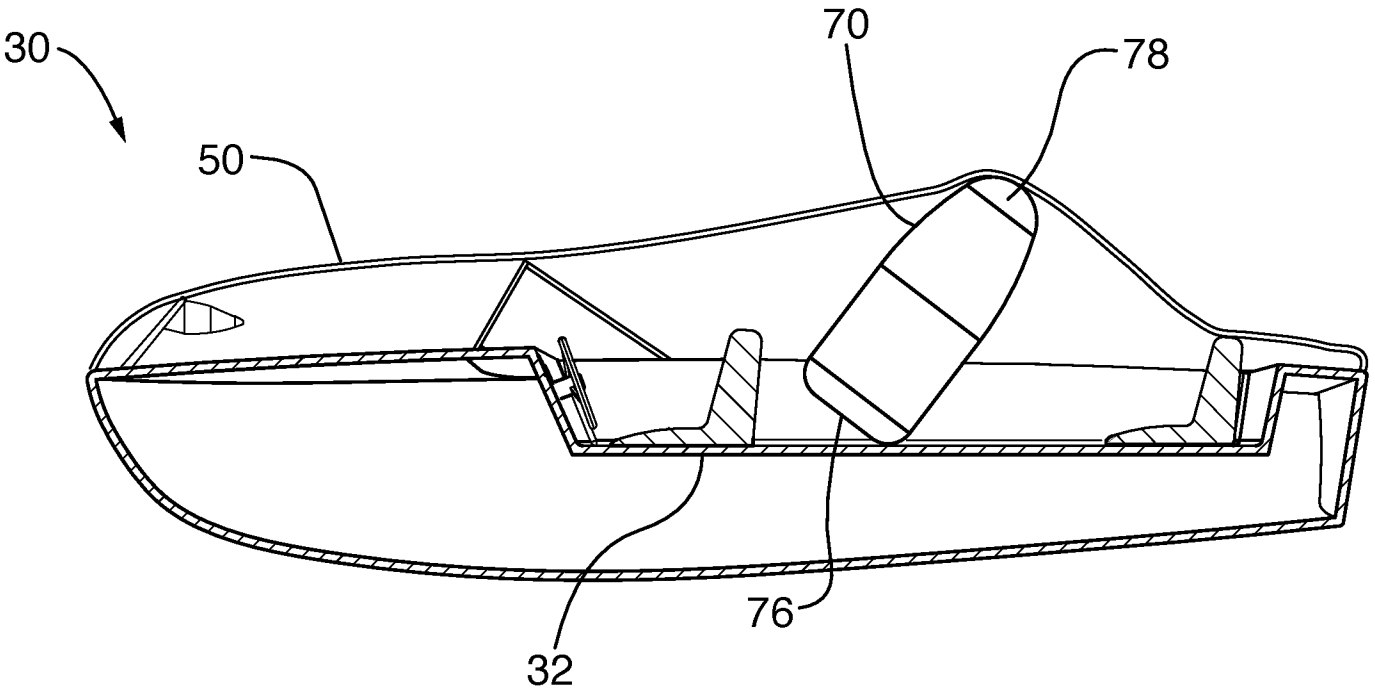
FIG. 7E is a partially sectional view of the covered boat and air bladder of FIG. 7D, shown without the front straps, and showing the air bladder in a tipped-back configuration.

As shown in FIGS. 6B and 7B, some embodiments of the device 60 are particularly well-adapted to be used when the deck 32 of the boat 30 is shaped to define a floor cavity 132 therein. The base portion 76 securely engages the deck 32 of the boat 30 within the floor cavity 132. The device 60 then also includes a removable floor cover 130 that is adapted to securely cover the floor cavity 132. In these embodiments, the air bladder 70 can be securely stored within the floor cavity 132 under the removable floor cover 130.

As mentioned, the device 60 may preferably include one or more support straps 122 securely engaging the air bladder 70. The support straps 122 securely engaging the air bladder 70 at strap connection points 80. The support straps 122 also securely engage one or more cleats or other tie-down connection points 36 integrally provided on the boat 30, to help keep the air bladder 70 upright when in an inflated configuration.

In some embodiments of the invention, the device 60 also includes (as shown in FIG. 17A) a pole base member 128, and a mechanical telescoping pole 124 securely engaging the air bladder 70 (e.g., via straps 122) and the pole base member 128, to help keep the air bladder 70 upright when in an inflated configuration.

In some embodiments, the device 60 also includes (as shown in FIG. 17B) an internal telescopic mechanism 126, inside the internal air chamber 74, that engages the top portion 78 and the base portion 76 inside the internal air chamber 74 to help keep the air bladder 70 upright when in an inflated configuration.

The invention is contemplated for use in association with covers 50 for boats 30 (and trailers 40, etc.), related systems and methods, and in association with their storage, to afford increased functionality and advantageous utilities in association with same. The invention, however, is not so limited.

In other preferred embodiments of the invention, additional support options may be provided to help stabilize the inflated cylinder 70 if, when, and as may be necessary or desired. Some such support options may include one or more mechanical poles 124, pneumatic arms, and/or internal telescopic mechanisms 126. Likewise, although preferred embodiments may include a pneumatically inflatable cylinder 70, other embodiments (within the scope of the invention) may include other inflatable items and/or the invention may instead hydraulically and/or mechanically raise and lower the cover.

The foregoing description has been presented for the purpose of illustration and is not intended to be exhaustive or to limit the invention to the precise form disclosed.

Naturally, in view of the teachings and disclosures herein, persons having ordinary skill in the art may appreciate that alternate designs and/or embodiments of the invention may be possible (e.g., with substitution of one or more components for others, with alternate configurations of components, etc). Although some of the components, relations, configurations and/or steps according to the invention are not specifically referenced in association with one another, they may be used, and/or adapted for use, in association therewith. All of the aforementioned, depicted and various structures, configurations, relationships, utilities and the like may be, but are not necessarily, incorporated into and/or achieved by the invention. Any one or more of the aforementioned structures, configurations, relationships, utilities and the like may be implemented in and/or by the invention, on their own, and/or without reference, regard or likewise implementation of any of the other aforementioned structures, configurations, relationships, utilities and the like, in various permutations and combinations, as will be readily apparent to those skilled in the art, without departing from the pith, marrow, and spirit of the disclosed invention.

Other modifications and alterations may be used in the design, manufacture, and/or implementation of other embodiments according to the present invention without departing from the spirit and scope of the invention, which is limited only by the accompanying claims.

The invention claimed is:

1. A jack device, for use with a removable boat cover secured over a boat and with a pump outside the boat, the device comprising:

(a) an air bladder that is selectively inflatable and deflatable, has a top portion, and is shaped to define an internal air chamber; wherein the air bladder is adapted to be securely positioned inside the boat under the boat cover;

(b) an airline that has a pump nozzle, and is connected to the air bladder in fluid communication with the internal air chamber to inflate and deflate the air bladder; wherein the pump nozzle is adapted to be readily connected to the pump outside the boat, and adapted for fluid communication of air from the pump to the internal air chamber, thus, to selectively inflate the air bladder when the boat cover is secured over the boat; and (c) a two-way valve, provided on the airline, that is readily and selectively controllable and positionable either (i) to deflate the air bladder, or (ii) to permit fluid communication of air from the pump through the airline to the internal air chamber; wherein the two-way valve on the airline is adapted to be positioned outside the boat, thus, to permit ready and selective control of the two-way valve from outside the boat;

wherein, when the pump nozzle is connected to the pump and the two-way valve is positioned to permit said fluid communication of air from the pump through the airline to the internal air chamber, when the pump is operated, the air bladder is inflated and the top portion of the air bladder engages an underside of the boat cover and pulls the boat cover taut over the boat, thus, to help minimize and protect against water pooling on the boat cover;

wherein the air bladder has a base portion with a bottom surface that is substantially flat and adapted to securely engage a deck of the boat, and the airline extends over a wall of the boat to outside the boat;

wherein the base portion is weighted to bias the air bladder towards an upright configuration when inflated.

2. A device according to claim 1, wherein the air bladder, the airline, and the two-way valve are readily portable, and the air bladder is adapted for ready positioning inside the boat under the boat cover and for ready removal therefrom.

3. A device according to claim 1, wherein the airline has a diameter that fits, under the boat cover, between the boat cover and the boat.

4. A device according to claim 1, wherein when the pump is operated as aforesaid, the air bladder is selectively inflated and the top portion is raised, together with the boat cover, to a selected height to provide the boat cover with a selected tautness.

5. A device according to claim 1, wherein the air bladder is further adapted to first, in a substantially deflated configuration, be positioned inside the boat with the airline extending outside the boat when the boat cover is removed from the boat, before the boat cover is readily secured over the boat and the pump is then operated as aforesaid to selectively inflate the air bladder with the boat cover secured over the boat.

6. A device according to claim 1, wherein the pump nozzle is further adapted to be readily disconnected from and reconnected with the pump outside the boat while the boat cover is secured over the boat, thus, to selectively reinflate the air bladder to maintain the boat cover with a selected tautness while the boat cover is secured over the boat.

7. A device according to claim 1, wherein the air bladder is adapted, in a substantially deflated configuration, to be readily removed from the boat and transported.

8. A jack device, for use with a removable boat cover secured over a boat and with a pump outside the boat, the device comprising:

(a) an air bladder that is selectively inflatable and deflatable, has a top portion, and is shaped to define an internal air chamber; wherein the air bladder is adapted to be securely positioned inside the boat under the boat cover;

(b) an airline that has a pump nozzle, and is connected to the air bladder in fluid communication with the internal air chamber to inflate and deflate the air bladder; wherein the pump nozzle is adapted to be readily connected to the pump outside the boat, and adapted for fluid communication of air from the pump to the internal air chamber, thus, to selectively inflate the air bladder when the boat cover is secured over the boat; and (c) a two-way valve, provided on the airline, that is readily and selectively controllable and positionable either (i) to deflate the air bladder, or (ii) to permit fluid communication of air from the pump through the airline to the internal air chamber; wherein the two-way valve on the airline is adapted to be positioned outside the boat, thus, to permit ready and selective control of the two-way valve from outside the boat;

wherein, when the pump nozzle is connected to the pump and the two-way valve is positioned to permit said fluid communication of air from the pump through the airline to the internal air chamber, when the pump is operated, the air bladder is inflated and the top portion of the air bladder engages an underside of the boat cover and pulls the boat cover taut over the boat, thus, to help minimize and protect against water pooling on the boat cover;

further adapted for use with a deck of the boat when the deck is shaped to define a floor cavity therein; wherein the air bladder has a base portion that is adapted to securely engage the deck of the boat within the floor cavity; wherein the device further comprises a removable floor cover that is adapted to securely cover the floor cavity; and wherein the air bladder is adapted to be securely stored within the floor cavity under the removable floor cover.

9. A jack device, for use with a removable boat cover secured over a boat and with a pump outside the boat, the device comprising:

(a) an air bladder that is selectively inflatable and deflatable, has a top portion, and is shaped to define an internal air chamber; wherein the air bladder is adapted to be securely positioned inside the boat under the boat cover;

(b) an airline that has a pump nozzle, and is connected to the air bladder in fluid communication with the internal air chamber to inflate and deflate the air bladder; wherein the pump nozzle is adapted to be readily connected to the pump outside the boat, and adapted for fluid communication of air from the pump to the internal air chamber, thus, to selectively inflate the air bladder when the boat cover is secured over the boat; and (c) a two-way valve, provided on the airline, that is readily and selectively controllable and positionable either (i) to deflate the air bladder, or (ii) to permit fluid communication of air from the pump through the airline to the internal air chamber; wherein the two-way valve on the airline is adapted to be positioned outside the boat, thus, to permit ready and selective control of the two-way valve from outside the boat;

wherein, when the pump nozzle is connected to the pump and the two-way valve is positioned to permit said fluid communication of air from the pump through the airline to the internal air chamber, when the pump is operated, the air bladder is inflated and the top portion of the air bladder engages an underside of the boat cover and pulls the boat cover taut over the boat, thus, to help minimize and protect against water pooling on the boat cover;

further comprising one or more support straps securely engaging the air bladder, and wherein the support straps are adapted to also securely engage one or more tie-down connection points integrally provided on the boat, to help keep the air bladder upright when in an inflated configuration.

10. A jack device, for use with a removable boat cover secured over a boat and with a pump outside the boat, the device comprising:

(a) an air bladder that is selectively inflatable and deflatable, has a top portion, and is shaped to define an internal air chamber: wherein the air bladder is adapted to be securely positioned inside the boat under the boat cover;

(b) an airline that has a pump nozzle, and is connected to the air bladder in fluid communication with the internal air chamber to inflate and deflate the air bladder wherein the pump nozzle is adapted to be readily connected to the pump outside the boat, and adapted for fluid communication of air from the pump to the internal air chamber, thus, to selectively inflate the air bladder when the boat cover is secured aver the boat; and (c) a two-way valve, provided on the airline, that is readily and selectively controllable and positionable either (i) to deflate the air bladder, or (ii) to permit fluid communication of air from the pump through the airline to the internal air chamber; wherein the two-way valve on the airline is adapted to be positioned outside the boat, thus, to permit ready and selective control of the two-way valve from outside the boat;

wherein, when the pump nozzle is connected to the pump and the two-way valve is positioned to permit said fluid communication of air from the pump through the airline to the internal air chamber, when the pump is operated, the air bladder is inflated and the top portion of the air bladder engages an underside of the boat cover and pulls the boat cover taut over the boat, thus, to help minimize and protect against water pooling on the boat cover;

further comprising a pole base member, and one or more mechanical telescoping poles securely engaging the air bladder and the pole base member, to help keep the air bladder upright when in an inflated configuration.

11. A device according to claim 1, wherein the device further comprises an internal telescopic mechanism, inside the internal air chamber, that engages the top portion and the base portion inside the internal air chamber to help keep the air bladder upright when in an inflated configuration.

* * * * *